US011109163B2

(12) United States Patent
Pedersen et al.

(10) Patent No.: US 11,109,163 B2
(45) **Date of Patent: *Aug. 31, 2021**

(54) HEARING AID COMPRISING A BEAM FORMER FILTERING UNIT COMPRISING A SMOOTHING UNIT

(71) Applicant: Oticon A/S, Smørum (DK)

(72) Inventors: Michael Syskind Pedersen, Smørum (DK); Jan Mark De Haan, Smørum (DK); Jesper Jensen, Smørum (DK)

(73) Assignee: OTICON A/S, Smørum (DK)

( * ) Notice: Subject to any disclaimer, the term of this patent is extended or adjusted under 35 U.S.C. 154(b) by 247 days.

This patent is subject to a terminal disclaimer.

(21) Appl. No.: 16/256,742

(22) Filed: Jan. 24, 2019

(65) Prior Publication Data

US 2019/0158965 A1 May 23, 2019

Related U.S. Application Data

(63) Continuation of application No. 15/608,294, filed on May 30, 2017, now Pat. No. 10,231,062.

(30) Foreign Application Priority Data

May 30, 2016 (EP) ..... 16172042

(51) Int. Cl.
*H04R 25/00* (2006.01)
*G10L 21/0208* (2013.01)
*H04R 3/00* (2006.01)

(52) U.S. Cl.
CPC ..... *H04R 25/407* (2013.01); *G10L 21/0208* (2013.01); *H04R 3/005* (2013.01);
(Continued)

(58) Field of Classification Search
CPC ..... H04R 3/005; H04R 3/04; H04R 25/405; H04R 25/407; H04R 25/505;
(Continued)

(56) References Cited

U.S. PATENT DOCUMENTS 5,473,701 A 12/1995 Cezanne et al.
6,983,055 B2 1/2006 Luo
(Continued)

FOREIGN PATENT DOCUMENTS

EP 2296142 A2 3/2011

OTHER PUBLICATIONS

Bai et al.; "Frequency-Domain Array Beamformers for Noise Reduction", In "Acoustic Array Systems", Jan. 29, 2013, John Wiley & Sons Singapore Pte. Ltd., Singapore, pp. 315-344.
(Continued)

*Primary Examiner* — Huyen D Le
(74) *Attorney, Agent, or Firm* — Birch, Stewart, Kolasch & Birch, LLP.

(57) ABSTRACT

A hearing aid comprises a resulting beam former (Y) for providing a resulting beamformed signal $Y_{BF}$ based on first and second electric input signals $IN_1$ and $IN_2$, first and second sets of complex frequency dependent weighting parameters $W_{11}(k)$, $W_{12}(k)$ and $W_{21}(k)$, $W_{22}(k)$, and a resulting complex, frequency dependent adaptation parameter $\beta(k)$. $\beta(k)$ may be determined as $<C_2^*\cdot C_1>/<(|C2|^2>+c)$, where * denotes the complex conjugation and (·) denotes the statistical expectation operator, and c is a constant, and wherein said adaptive beam former filtering unit (BFU) comprises a smoothing unit for implementing said statistical expectation operator by smoothing the complex expression $C_2^*\cdot C_1$ and the real expression $|C_2|^2$ over time. Alternatively, $\beta(k)$ may be determined from the following expression (Continued)

$$\beta = \frac{w_{C1}^{H} C_v w_{C2}}{w_{C2}^{H} C_v w_{C2}},$$

where $w_{C1}$ and $w_{C2}$ are the beamformer weights representing the first ($C_1$) and the second ($C_2$) beamformers, respectively, $C_v$ is a noise covariance matrix, and H denotes Hermitian transposition. Corresponding methods of operating a hearing aid, and a hearing aid utilizing smoothing β(k) based on adaptive covariance smoothing are disclosed.

21 Claims, 16 Drawing Sheets

(52) U.S. Cl.
CPC ..... *H04R 3/007* (2013.01); *H04R 25/405* (2013.01); *H04R 25/505* (2013.01); *H04R 25/55* (2013.01); *H04R 25/552* (2013.01); *H04R 25/606* (2013.01); *H04R 2225/0216* (2019.05); *H04R 2225/67* (2013.01); *H04R 2430/20* (2013.01); *H04R 2430/23* (2013.01); *H04R 2430/25* (2013.01)

(58) Field of Classification Search
CPC ..... H04R 25/552; H04R 2430/20; H04R 2430/21; H04R 2430/23; H04R 3/007; H04R 25/606; H04R 2225/0216; H04R 2225/67; H04R 2430/25
See application file for complete search history.

(56) References Cited

U.S. PATENT DOCUMENTS

| | | | | |
|---|---|---|---|---|
| 9,224,393 | B2 * | 12/2015 | Kjems | H04R 3/005 |
| 9,301,049 | B2 | 3/2016 | Elko et al. | |
| 9,832,576 | B2 | 11/2017 | Jensen et al. | |
| 10,165,373 | B2 * | 12/2018 | Bertelsen | H04R 25/405 |
| 2012/0308038 | A1 | 12/2012 | Shuang et al. | |
| 2014/0126745 | A1 | 5/2014 | Dickins et al. | |
| 2015/0221313 | A1 | 8/2015 | Purnhagen et al. | |
| 2017/0105074 | A1 * | 4/2017 | Jensen | H04R 25/405 |
| 2017/0295437 | A1 | 10/2017 | Bertelsen et al. | |

OTHER PUBLICATIONS

Elko, "Microphone array systems for hands-free telecommunication", Speech Communication, Elsevier Science Publishers, Amsterdam, NL, Dec. 1, 1996, vol. 20, No. 3, pp. 229-240.

Lockwood et al., "Performance of time- and frequency-domain binaural beamformers based on recorded signals from real rooms", The Journal of the Acoustical Society of America, American Institute of Physics for the Acoustical Society of America, New York, NY, Jan. 1, 2004, vol. 115, No. 1, pp. 379-391.

* cited by examiner

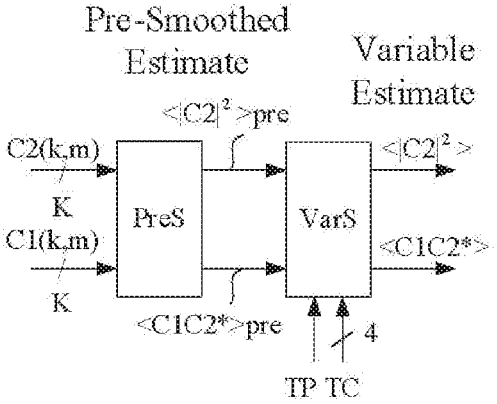
FIG. 16A
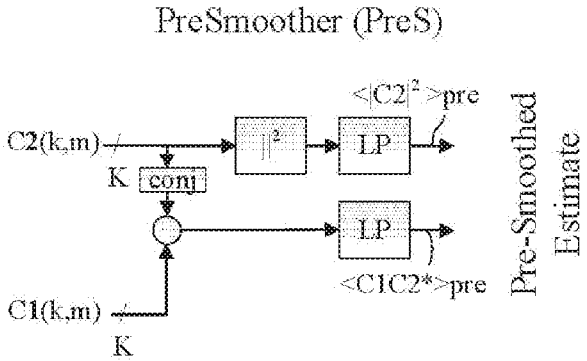
FIG. 16B
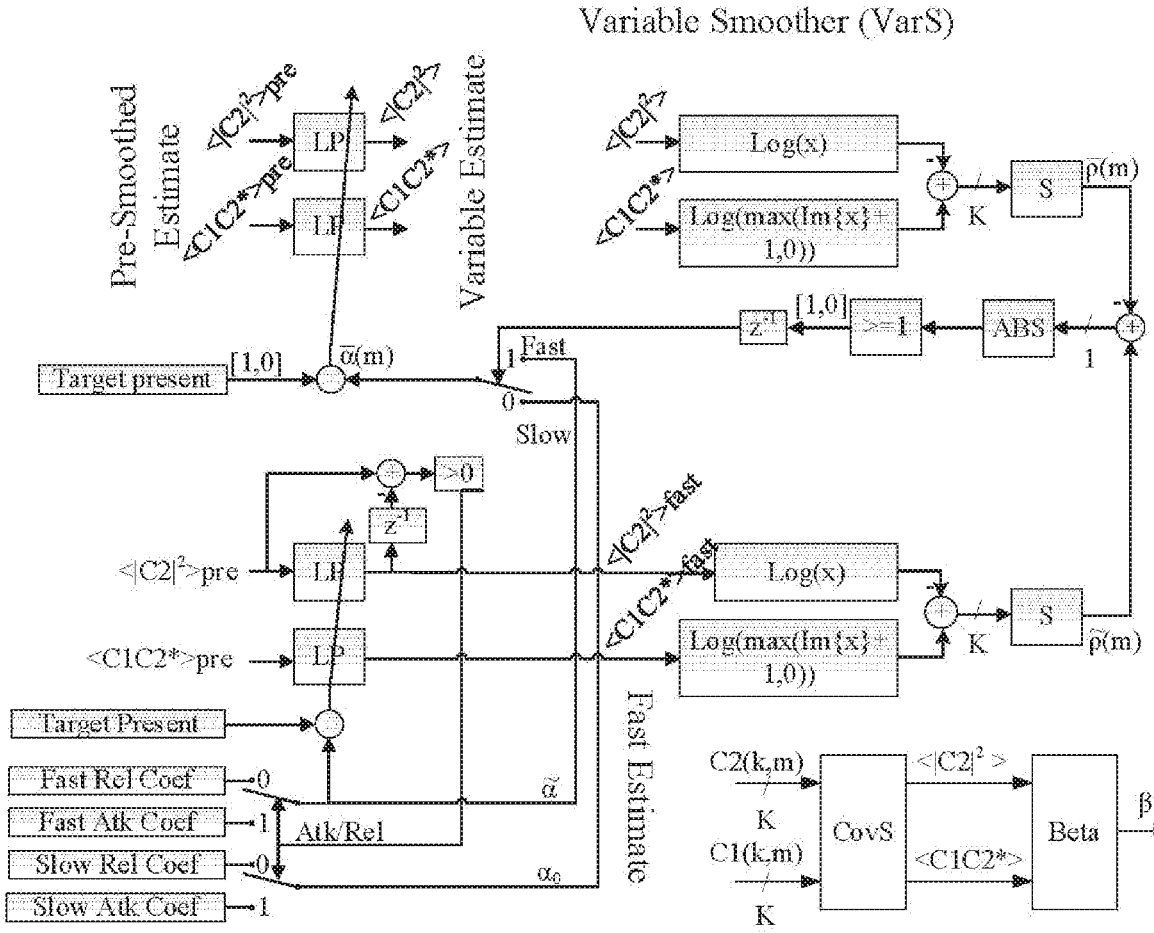
FIG. 16C
FIG. 16D

HEARING AID COMPRISING A BEAM FORMER FILTERING UNIT COMPRISING A SMOOTHING UNIT

CROSS-REFERENCE TO RELATED APPLICATIONS

This application is a Continuation of co-pending application Ser. No. 15/608,294, filed on May 30, 2017, which claims priority under 35 U.S.C. § 119(a) to Application No. 16172042.0, filed in the European Patent office on May 30, 2016, all of which are hereby expressly incorporated by reference into the present application.

SUMMARY

Spatial filtering (directionality) by beam forming in hearing aids is an efficient way to attenuate unwanted noise as a direction-dependent gain can cancel noise from one direction while preserving the sound of interest impinging from another direction hereby potentially improving the speech intelligibility. Typically, beam formers in hearing instruments have beam patterns, which continuously are adapted in order to minimize the noise while sound impinging from the target direction is unaltered. As the acoustic properties of the noise signal changes over time, the beam former is implemented as an adaptive system, which adapts the directional beam pattern in order to minimize the noise while the target sound (direction) is unaltered.

Despite the potential benefit, adaptive directionality also has some drawbacks. In a fluctuating acoustic environment, the adaptive system needs to react fast. The parameter estimates for such a fast system will have a high variance, which will lead to poorer performance in steady environments.

We thus propose a smoothing scheme which provides more smoothing of the adaptive parameter in fluctuating environments and less smoothing of the adaptive parameter in more steady acoustic environments.

In another aspect, a smoothing scheme based on adaptive covariance smoothing is presented, which may be advantageous in environments or situations where a direction to a sound source of interest changes (e.g. in that more than one (e.g. localized) sound source of interest is present and where the more than one sound sources are active at different points in time, e.g. one after the other, or un-correlated).

A hearing aid:

In a first aspect of the present application, a hearing aid adapted for being located in an operational position at or in or behind an ear or fully or partially implanted in the head of a user, is provided. The hearing aid comprises first and second microphones ($M_{BTE1}$, $M_{BTE2}$) for converting an input sound to first $IN_1$ and second $IN_2$ electric input signals, respectively, an adaptive beam former filtering unit (BFU) for providing a resulting beamformed signal $Y_{BF}$, based on said first and second electric input signals, the adaptive beam former filtering unit comprising, a first memory comprising a first set of complex frequency dependent weighting parameters $W_{11}(k)$, $W_{12}(k)$ representing a first beam pattern (C1), where k is a frequency index, k=1, 2, . . . , K, a second memory comprising a second set of complex frequency dependent weighting parameters $W_{21}(k)$, $W_{22}(k)$ representing a second beam pattern (C2), where said first and second sets of weighting parameters $W_{11}(k)$, $W_{12}(k)$ and $W_{21}(k)$, $W_{22}(k)$, respectively, are predetermined and possibly updated during operation of the hearing aid, an adaptive beam former processing unit for providing an adaptively determined adaptation parameter β(k) representing an adaptive beam pattern (ABP) configured to attenuate unwanted noise as much as possible under the constraint that sound from a target direction is essentially unaltered, and a resulting beam former (Y) for providing said resulting beamformed signal $Y_{BF}$ based on said first and second electric input signals $IN_1$ and $IN_2$, said first and second sets of complex frequency dependent weighting parameters $W_{11}(k)$ $W_{12}(k)$ and $W_{21}(k)$, $W_{22}(k)$, and said resulting complex, frequency dependent adaptation parameter β(k), where β(k) may be determined as $$\beta(k) = \frac{\langle C_2^* C_1 \rangle}{\langle |C_2|^2 \rangle + c'}$$

where * denotes the complex conjugation and ⟨ ⟩ denotes the statistical expectation operator, and c is a constant. The hearing aid is adapted to provide that said adaptive beam former filtering unit (BFU) comprises a smoothing unit for implementing said statistical expectation operator by smoothing the complex expression $C_2^* \cdot C_1$ and the real expression $|C_2|^2$ over time.

In a second aspect, of the present application, a hearing aid adapted for being located in an operational position at or in or behind an ear or fully or partially implanted in the head of a user, is provided. The hearing aid comprises first and second microphones ($M_{BTE1}$, $M_{BTE2}$) for converting an input sound to first $IN_1$ and second $IN_2$ electric input signals, respectively, an adaptive beam former filtering unit (BFU) for providing a resulting beamformed signal $Y_{BF}$, based on said first and second electric input signals, the adaptive beam former filtering unit comprising, a first memory comprising a first set of complex frequency dependent weighting parameters $W_{11}(k)$, $W_{12}(k)$ representing a first beam pattern (C1), where k is a frequency index, k=1, 2, . . . , K, a second memory comprising a second set of complex frequency dependent weighting parameters $W_{21}(k)$, $W_{22}(k)$ representing a second beam pattern (C2), where said first and second sets of weighting parameters $W_{11}(k)$, $W_{12}(k)$ and $W_{21}(k)$, $W_{22}(k)$, respectively, are predetermined and possibly updated during operation of the hearing aid, an adaptive beam former processing unit for providing an adaptively determined adaptation parameter β(k) representing an adaptive beam pattern (ABP) configured to attenuate unwanted noise as much as possible under the constraint that sound from a target direction is essentially unaltered, and a resulting beam former (Y) for providing said resulting beamformed signal $Y_{BF}$ based on said first and second electric input signals $IN_1$ and $IN_2$, said first and second sets of complex frequency dependent weighting parameters $W_{11}(k)$, $W_{12}(k)$ and $W_{21}(k)$, $W_{22}(k)$, and said resulting complex, frequency dependent adaptation parameter β(k), wherein the adaptive beamformer processing unit is configured to determine the adaptation parameter β(k) from the following expression $$\beta = \frac{w_{C1}^H C_v w_{C2}}{w_{C2}^H C_v w_{C2}},$$

where $w_{C1}$ and $w_{C2}$ are the beamformer weights representing the first ($C_1$) and the second ($C_2$) beamformers, respectively, $C_v$ is the noise covariance matrix, and H denotes Hermitian transposition.

In an embodiment, $w_{C1}{}^H w_{C2}=0$, in other words, the first and second beam patterns are preferably mutually orthogonal. The following relations between beamformer weights and weighting parameters exist $w_{C1}=[W_{11},W_{12}]^T$ and $w_{C2}=[W_{21},W_{22}]^T$ In an embodiment, the first beam pattern (C1) represents a target maintaining beamformer, e.g. implemented as a delay and sum beamformer. In an embodiment, the second beam pattern (C2) represents a target cancelling beamformer, e.g. implemented as a delay and subtract beamformer. In another embodiment C1 represents a front cardioid and C2 represents a rear cardioid. This may also represent a target cancelling beamformer and a target enhancing beamformer, but the target enhancing beamformer is implemented as a delay and subtract (differential) beamformer.

The expression for β has its basis in the generalized side lobe canceller structure, where in a special case of two microphones, we have (assuming that $w_{C1}{}^H w_{C2}=0$)

$$w_{GSC}(k)=w_{C1}(k)-w_{C2}(k)\beta^*(k)$$

where (omitting the frequency index k)

$$\begin{aligned}\beta &= (w_{C2}^H C_v w_{C2})^{-1}(w_{C2}^H C_v w_{C1})^* \\ &= \frac{w_{C1}^H C_v w_{C2}}{w_{C2}^H C_v w_{C2}} \\ &= \frac{w_{C1}^H E[xx^H]_{VAD=0} w_{C2}}{w_{C2}^H E[xx^H]_{VAD=0} w_{C2}} \\ &= \frac{E[w_{C1}^H xx^H w_{C2}]_{VAD=0}}{E[w_{C2}^H xx^H w_{C2}]_{VAD=0}} \\ &= \frac{E[C_1 C_2^*]_{VAD=0}}{E[C_2 C_2^*]_{VAD=0}}.\end{aligned}$$

Where E[·] represents the expectation operator. VAD=0 represents a situation where speech is absent (e.g. only noise is present in the given time segment), VAD means Voice Activity Detector. x represents input signals or a processed version of the input signals (e.g. $x=1[X_1(k,m), X_2(k,m)]^T$). In the above expressions for β, $C_v$ is also updated when VAD=0.

We notice that we may find β either directly from the signals $C_1=w_{C1}{}^H x$ and $C_2=w_{C2}{}^H x$ (cf. 1st aspect) or we may find β from the noise covariance matrix $C_v$, i.e.

$$\beta = \frac{w_{C1}^H C_v w_{C2}}{w_{C2}^H C_v w_{C2}}$$

(cf. second aspect). This may be a choice of implementation. If, e.g., signals $C_1$ and $C_2$ are already used elsewhere in the device or algorithm, it may be advantageous to derive β directly from these signals $$\left(\beta = \frac{E[C_1 C_2^*]_{VAD=0}}{E[C_2 C_2^*]_{VAD=0}}\right),$$

but if we need to change the look direction (and hereby $w_{C1}$ and $w_{C2}$), it is a disadvantage that the weights are included inside the expectation operator. In that case, it is an advantage deriving β directly from the noise covariance matrix $C_v$ (as in the 2nd aspect. Thereby, $w_{C1}$ and $w_{C2}$ will not be part of the smoothing and thus β can change quickly based on for example a change in target DOA (which will result in change of $w_{C1}$ and $w_{C2}$, where $w_{C1}=[W_{11}\ W_{12}]^T$ and $w_{C2}=[W_{21}\ W_{22}]^T$). An embodiment of determining β according to this method is e.g. illustrated in FIG. 18 (with or without the use of covariance smoothing according to the present disclosure).

In an embodiment, the adaptive beam former filtering unit is configured to provide adaptive smoothing of a covariance matrix for said electric input signals comprising adaptively changing time constants ($\tau_{att1}$, $\tau_{rel}$) for said smoothing in dependence of changes (ΔC) over time in covariance of said first and second electric input signals, wherein said time constants have first values ($\tau_{att1}$, $\tau_{rel1}$) for changes in covariance below a first threshold value ($\Delta C_{th1}$) and second values ($\tau_{att2}$, $\tau_{rel2}$) for changes in covariance above a second threshold value ($\Delta C_{th2}$), wherein the first values are larger than corresponding second values of said time constants, while said first threshold value ($\Delta C_{th1}$) is smaller than or equal to said second threshold value ($\Delta C_{th2}$). In an embodiment, the adaptive beam former filtering unit is configured to provide adaptive smoothing of the noise covariance matrix $C_v$. In an embodiment, the adaptive beam former filtering unit is configured to provide that the noise covariance matrix is $C_v$ is updated when only noise is present. In an embodiment, the hearing aid comprises a voice activity detector for providing a (binary or continuous, e.g. over frequency bands) indication of whether—at a given point in time—the input signal(s) comprise speech or not.

Thereby an improved beam former filtering unit may be provided.

The statistical expectation operator is approximated by a smoothing operation, e.g. implemented as a moving average, e.g. implemented by a low pass filter, e.g. a FIR filter, e.g. implemented by an infinite impulse response (IIR) filter.

In an embodiment, the smoothing unit is configured to apply substantially the same smoothing time constants for the smoothing of the complex expression $C_2{}^*\cdot C_1$ and the real expression $|C_2|^2$. In an embodiment, the smoothing time constants comprise attack and release time constants $\tau_{att}$ and $\tau_{rel}$. In an embodiment, the attack and release time constants are substantially equal. Thereby no bias is introduced in the estimate by the smoothing operation. In an embodiment, the smoothing unit is configured to enable the use of different attack and release time constants $\tau_{att}$ and $\tau_{rel}$ in the smoothing. In an embodiment, the attack time constants $\tau_{att}$ for the smoothing of the complex expression $C_2{}^*\cdot C_1$ and the real expression $|C_2|^2$ are substantially equal. In an embodiment, the release time constants $\tau_{rel}$ for the smoothing of the complex expression $C_2{}^*\cdot C_1$ and the real expression $|C_2|^2$ are substantially equal.

In an embodiment, the smoothing unit is configured to smoothe a resulting adaptation parameter β(k). In an embodiment, the smoothing unit is configured to provide that the is time constants of the smoothing of the resulting adaptation parameter $\beta(k)$ are different from the time constants of the smoothing complex expression $C_2^*\cdot C_1$ and the real expression $|C_2|^2$.

In an embodiment, the smoothing unit is configured to provide that the attack and release time constants involved in the smoothing of the resulting adaptation parameter $\beta(k)$ is larger than the corresponding attack and release time constants involved in the smoothing of the complex expression $C_2^*\cdot C_1$ and the real expression $|C_2|^2$. This has the advantage that smoothing of the signal level dependent expressions expression $C_2^*\cdot C_1$ and $|C_2|^2$ are performed relatively faster (so that a sudden level change (in particular a level drop) can be detected fast). The resulting increased variance in the resulting adaptation parameter $\beta(k)$ is handled by a performing a relatively slow smoothing of adaptation parameter $\beta(k)$ (providing smoothed adaptation parameter $\beta(k)=<\beta(k)>$).

In an embodiment, the smoothing unit is configured to provide that the attack and release time constants involved in the smoothing of the complex expression $C_2^*\cdot C_1$ and the real expression $|C_2|^2$ are adaptively determined.

In an embodiment, the smoothing unit is configured to provide that the attack and release time constants involved in the smoothing of the resulting adaptation parameter $\beta(k)$ are adaptively determined. In an embodiment, the smoothing unit comprises a low pass filter. In an embodiment, the low pass filter is adapted to allow the use of different attack and release coefficients. In an embodiment, the smoothing unit comprises a low pass filter implemented as an IIR filter with fixed or configurable time constant(s).

In an embodiment, the smoothing unit comprises a low pass filter implemented as an IIR filter with a fixed time constant, and an IIR filter with a configurable time constant. In an embodiment, the smoothing unit is configured to provide that the smoothing time constants take values between 0 and 1. A coefficient close to 0 applies averaging with a long time constant while a coefficient close to 1 applies a short time constant. In an embodiment, at least one of said IIR filters is a $1^{st}$ order IIR filter. In an embodiment, the smoothing unit comprises a number of $1^{st}$ order IIR filters.

In an embodiment, the smoothing unit is configured to determine the configurable time constant by a function unit providing a predefined function of the difference between a first filtered value of the real expression $|C_2|^2$ when filtered by an IIR filter with a first time constant, and a second filtered value of the real expression $|C_2|^2$ when filtered by an IIR filter with a second time constant, wherein the first time constant is smaller than the second time constant. In an embodiment, the smoothing unit comprises two $1^{st}$ order IIR filters using said first and second time constants for filtering said real expression $|C_2|^2$ and providing said first and second filtered values, and a combination unit (e.g. a sum or difference unit) for providing said difference between said first and second filtered values of the real expression $|C_2|^2$ and a function unit for providing said configurable time constant, and a $1^{st}$ order IIR filter for filtering the real expression $|C_2|^2$ using said configurable time constant.

In an embodiment, the function unit comprises an absolute value (ABS) unit providing an absolute value of the difference between the first and second filtered values.

In an embodiment, the first and second time constants are fixed time constants.

In an embodiment, the first time constant the fixed time constant and the second time constant is the configurable time constant.

In an embodiment, the predefined function is a decreasing function of the difference between the first and second filtered values. In an embodiment, the predefined function is a monotonously decreasing function of the difference between the first and second filtered values. The larger the difference between the first and second filtered values, the faster the smoothing should be performed, i.e. the smaller the time constant.

In an embodiment, the predefined function is one of a binary function, a piecewise linear function, and a continuous monotonous function. In an embodiment, predefined function is a sigmoid function.

In an embodiment, the smoothing unit comprises respective low pass filters implemented as IIR filters using said configurable time constant for filtering real and imaginary parts of the expression $C_2^*\cdot C_1$ and the real expression $|C_2|^2$, and wherein said configurable time constant is determined from $|C_2|^2$.

In an embodiment, the hearing aid comprises a hearing instrument adapted for being located at or in an ear of a user or for being fully or partially implanted in the head of a user, a headset, an earphone, an ear protection device or a combination thereof.

In an embodiment, the hearing aid is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing aid comprises a signal processing unit for enhancing the input signals and providing a processed output signal.

In an embodiment, the hearing aid comprises an output unit (e.g. a loudspeaker, or a vibrator or electrodes of a cochlear implant) for providing output stimuli perceivable by the user as sound. In an embodiment, the hearing aid comprises a forward or signal path between the first and second microphones and the output unit. In an embodiment, the beam former filtering unit is located in the forward path. In an embodiment, a signal processing unit is located in the forward path. In an embodiment, the signal processing unit is adapted to provide a level and frequency dependent gain according to a user's particular needs. In an embodiment, the hearing aid comprises an analysis path comprising functional components for analyzing the electric input signal(s) (e.g. determining a level, a modulation, a type of signal, an acoustic feedback estimate, etc.). In an embodiment, some or all signal processing of the analysis path and/or the forward path is conducted in the frequency domain. In an embodiment, some or all signal processing of the analysis path and/or the forward path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing aids comprise an analogue-to-digital (AD) converter to digitize an analogue input with a predefined sampling rate, e.g. 20 kHz. In an embodiment, the hearing aids comprise a digital-to-analogue (DA) converter to convert a digital signal to an analogue output signal, e.g. for being presented to a user via an output transducer.

In an embodiment, the hearing aid, e.g. the first and second microphones each comprises a (TF-)conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing aid from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing aid is split into a number NI of frequency bands, where NI is e.g. larger than 5, such as larger than 10, such as larger than 50, such as larger than 100, such as larger than 500, at least some of which are processed individually. In an embodiment, the hearing aid is/are adapted to process a signal of the forward and/or analysis path in a number NP of different frequency channels (NP≤NI). The frequency channels may be uniform or non-uniform in width (e.g. increasing in width with frequency), overlapping or non-overlapping. Each frequency channel comprises one or more frequency bands.

In an embodiment, the hearing aid is portable device, e.g. a device comprising a local energy source, e.g. a battery, e.g. a rechargeable battery.

In an embodiment, the hearing aid comprises a hearing instrument, e.g. a hearing instrument adapted for being located at the ear or fully or partially in the ear canal of a user, or for being fully or partially implanted in the head of the user.

In an embodiment, the hearing aid comprises a number of detectors configured to provide status signals relating to a current physical environment of the hearing aid (e.g. the current acoustic environment), and/or to a current state of the user wearing the hearing aid, and/or to a current state or mode of operation of the hearing aid. Alternatively or additionally, one or more detectors may form part of an external device in communication (e.g. wirelessly) with the hearing aid. An external device may e.g. comprise another hearing assistance device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain).

In an embodiment, the number of detectors comprises a level detector for estimating a current level of a signal of the forward path. In an embodiment, the number of detectors comprises a noise floor detector. In an embodiment, the number of detectors comprises a telephone mode detector.

In a particular embodiment, the hearing aid comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE. In an embodiment, the voice activity detector is adapted to differentiate between a user's own voice and other voices.

In an embodiment, the hearing aid comprises an own voice detector for detecting whether a given input sound (e.g. a voice) originates from the voice of the user of the system. In an embodiment, the microphone system of the hearing aid is adapted to be able to differentiate between a user's own voice and another person's voice and possibly from NON-voice sounds.

In an embodiment, the memory comprise a number of fixed adaptation parameter $\beta_{fixj}(k)$, $j=1, \ldots, N_{fix}$, where $N_{fix}$ is the number of fixed beam patterns, representing different (third) fixed beam patterns, which may be selected in dependence of a control signal, e.g. from a user interface or based on a signal from one or more detectors. In an embodiment, the choice of fixed beam former is dependent on a signal from the own voice detector and/or from a telephone mode detector.

In an embodiment, the hearing assistance device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing aid, or other properties of the current environment than acoustic;

b) the current acoustic situation (input level, feedback, etc.), and c) the current mode or state of the user (movement, temperature, etc.);

d) the current mode or state of the hearing assistance device (program selected, time elapsed since last user interaction, etc.) and/or of another device in communication with the hearing aid.

In an embodiment, the hearing aid further comprises other relevant functionality for the application in question, e.g. compression, noise reduction, feedback suppression, etc.

In an embodiment, the hearing aid comprises a hearing instrument, e.g. a hearing instrument adapted for being located at the ear or fully or partially in the ear canal of a user or fully or partially implanted in the head of a user, a headset, an earphone, an ear protection device or a combination thereof.

Use:

In an aspect, use of a hearing aid as described above, in the 'detailed description of embodiments' and in the claims, is moreover provided. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method of Operating a Hearing Aid:

In an aspect, a method of operating a hearing aid adapted for being located in an operational position at or in or behind an ear or fully or partially implanted in the head of a user is provided. The method comprises providing (e.g. converting an input sound to) first $IN_1$ and second $IN_2$ electric input signals, adaptively providing a resulting beamformed signal $Y_{BF}$, based on said first and second electric input signals;

storing in a first memory a first set of complex frequency dependent weighting parameters $W_{11}(k)$, $W_{12}(k)$ representing a first beam pattern (C1), where k is a frequency index, k=1, 2, . . . , K;

storing in a second memory comprising a second set of complex frequency dependent weighting parameters $W_{21}(k)$, $W_{22}(k)$ representing a second beam pattern (C2), wherein said first and second sets of weighting parameters $W_{11}(k)$, $W_{12}(k)$ and $W_{21}(k)$, $W_{22}(k)$, respectively, are predetermined and possibly updated during operation of the hearing aid providing an adaptively determined adaptation parameter β(k) representing an adaptive beam pattern (ABP) configured to attenuate unwanted noise as much as possible under the constraint that sound from a target direction is essentially unaltered, and providing said resulting beamformed signal $Y_{BF}$ based on said first and second electric input signals $IN_1$ and $IN_2$, said first and second sets of complex frequency dependent weighting parameters $W_{11}(k)$, $W_{12}(k)$ and $W_{21}(k)$, $W_{22}(k)$, and said resulting complex, frequency dependent adaptation parameter β(k), where β(k) may be determined as $$\beta(k) = \frac{\langle C_2^* C_1 \rangle}{\langle |C_2|^2 \rangle + c},$$

where * denotes the complex conjugation and ⟨ ⟩ denotes the statistical expectation operator, and c is a constant. The method further comprises smoothing the complex expression C2*·C1 and the real expression $|C_2|^2$ over time.

In a further aspect, of the present application, a method of operating a hearing aid adapted for being located in an operational position at or in or behind an ear or fully or partially implanted in the head of a user is provided. The method comprises providing (e.g. converting an input sound to) first $IN_1$ and second $IN_2$ electric input signals, adaptively providing a resulting beamformed signal $Y_{BF}$, based on said first and second electric input signals;

storing in a first memory a first set of complex frequency dependent weighting parameters $W_{11}(k)$, $W_{12}(k)$ representing a first beam pattern (C1), where k is a frequency index, k=1, 2, . . . , K;

storing in a second memory comprising a second set of complex frequency dependent weighting parameters $W_{21}(k)$, $W_{22}(k)$ representing a second beam pattern (C2), wherein said first and second sets of weighting parameters $W_{11}(k)$, $W_{12}(k)$ and $W_{21}(k)$, $W_{22}(k)$, respectively, are predetermined and possibly updated during operation of the hearing aid, providing an adaptively determined adaptation parameter β(k) representing an adaptive beam pattern (ABP) configured to attenuate unwanted noise as much as possible under the constraint that sound from a target direction is essentially unaltered, and providing said resulting beamformed signal $Y_{BF}$ based on said first and second electric input signals $N_1$ and $IN_2$, said first and second sets of complex frequency dependent weighting parameters $W_{11}(k)$, $W_{12}(k)$ and $W_{21}(k)$, $W_{22}(k)$, and said resulting complex, frequency dependent adaptation parameter β(k), wherein said resulting complex, frequency dependent adaptation parameter β(k) is determined from the following expression $$\beta = \frac{w_{C1}^H C_v w_{C2}}{w_{C2}^H C_v w_{C2}},$$

where $w_{C1}$ and $w_{C2}$ are the beamformer weights representing the first ($C_1$) and the second ($C_2$) beamformers, respectively, $C_v$ is a noise covariance matrix, and H denotes Hermitian transposition.

In an embodiment, $w_{C1}{}^H w_{C2}=0$, in other words, the first and second beam patterns are preferably mutually orthogonal.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

A Method of Adaptive Covariance Matrix Smoothing

In another aspect, a smoothing scheme based on adaptive covariance smoothing, is provided by the present disclosure. Adaptive covariance smoothing may be advantageous in environments or situations where a direction to a sound source of interest changes, e.g. in that more than one (in space) stationary or semi stationary sound source is present and where the sound sources are active at different points in time, e.g. one after the other, or un-correlated in time.

A method of operating a hearing device, e.g. a hearing aid, is provided. The method comprises providing (e.g. converting an input sound to) first $X_1$ and second $X_2$ electric input signals, adaptively providing a resulting beamformed signal $Y_{BF}$, based on said first and second electric input signals utilizing adaptive smoothing of a covariance matrix for said electric input signals comprising adaptively changing time constants ($\tau_{att}$, $\tau_{rel}$) for said smoothing in dependence of changes (ΔC) over time in covariance of said first and second electric input signals;

wherein said time constants have first values ($\tau_{att1}$, $\tau_{rel1}$) for changes in covariance below a first threshold value ($\Delta C_{th1}$) and second values $\tau_{att2}$, $\tau_{rel2}$) (for changes in covariance above a second threshold value ($\Delta C_{th2}$), wherein the first values are larger than corresponding second values of said time constants, while said first threshold value ($\Delta C_{th1}$) is smaller than or equal to said second threshold value ($\Delta C_{th2}$).

In an embodiment, the first $X_1$ and second $X_2$ electric input signals are provided in a time frequency representation $X_1(k,m)$ and second $X_2(k,m)$, where k is a frequency index, k=1, . . . , K and m is time frame index. In an embodiment, said changes ($\Delta C$) over time in covariance of said first and second electric input signals are related to changes over one or more time (possibly overlapping) frames (i.e. $\Delta m \geq 1$).

In an embodiment, said time constants represent attack and release time constants, respectively ($\tau_{att}$, $\tau_{rel}$).

A Hearing Device Comprising an Adaptive Beamformer.

A hearing device configured to implement the method adaptive covariance matrix smoothing is also provided.

A hearing device, e.g. a hearing aid, is furthermore provided. The hearing device comprises first and second microphones ($M_1$, $M_2$) for converting an input sound to first $IN_1$ and second $IN_2$ electric input signals, respectively, an adaptive beam former filtering unit (BFU) configured to adaptively provide a resulting beamformed signal $Y_{BF}$, based on said first and second electric input signals utilizing adaptive smoothing of a covariance matrix for said electric input signals comprising adaptively changing time constants ($\tau_{att}$, $\tau_{rel}$) for said smoothing in dependence of changes ($\Delta C$) over time in covariance of said first and second electric input signals;

wherein said time constants have first values ($\tau_{att1}$, $\tau_{rel1}$) for changes in covariance below a first threshold value ($\Delta C_{th1}$) and second values $\tau_{att2}$, $\tau_{rel2}$) (for changes in covariance above second threshold value ($\Delta C_{th2}$), wherein the first values are larger than corresponding second values of said time constants, while said first threshold value ($\Delta C_{th1}$) is smaller than or equal to said second threshold value ($\Delta C_{th2}$).

This has the advantage of providing an improved hearing device that is suitable for determining a direction of arrival (and/or location over time) of sound from sources in a dynamic listening environment with multiple competing speakers (and thus to steer a beam towards a currently active sound source).

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing aid as described above, in the 'detailed description of embodiments', and in the claims, AND an auxiliary device is moreover provided.

In an embodiment, the system is adapted to establish a communication link between the hearing aid and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing aid. In an embodiment, the auxiliary device is or comprises a remote control for controlling functionality and operation of the hearing aid(s). In an embodiment, the function of a remote control is implemented in a SmartPhone, the SmartPhone possibly running an APP allowing to control the functionality of the audio processing device via the SmartPhone (the hearing aid(s) comprising an appropriate wireless interface to the SmartPhone, e.g. based on Bluetooth or some other standardized or proprietary scheme). In an embodiment, the auxiliary device is or comprises a smartphone, or similar communication device.

In an embodiment, the auxiliary device is another hearing aid. In an embodiment, the hearing system comprises two hearing aids adapted to implement a binaural hearing aid system.

In an embodiment, the binaural hearing aid system (e.g. each of the first and second hearing aids of the binaural hearing aid system) is (are) configured binaurally exchange the smoothed beta values in order to create one joint $\beta_{bin}(k)$ value based on a combination of the two first and second smoothed β-values, $\beta_1(k)$, $\beta_2(k)$, of the first and second hearing aids, respectively.

Definitions:

In the present context, a 'hearing aid' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing aid' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing aid may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing aid may comprise a single unit or several units communicating electronically with each other.

More generally, a hearing aid comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing aids, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing aid and/or for storing information (e.g. processed information, e.g. provided by the signal processing circuit), e.g. for use in connection with an interface to a user and/or an interface to a programming device. In some hearing aids, the output means may comprise an output transducer, such as e.g. a loudspeaker for providing an air-borne acoustic signal or a vibrator for providing a structure-borne or liquid-borne acoustic signal. In some hearing aids, the output means may comprise one or more output electrodes for providing electric signals.

In some hearing aids, the vibrator may be adapted to provide a structure-borne acoustic signal transcutaneously or percutaneously to the skull bone. In some hearing aids, the vibrator may be implanted in the middle ear and/or in the inner ear. In some hearing aids, the vibrator may be adapted to provide a structure-borne acoustic signal to a middle-ear bone and/or to the cochlea. In some hearing aids, the vibrator may be adapted to provide a liquid-borne acoustic signal to the cochlear liquid, e.g. through the oval window. In some hearing aids, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing aids, and a 'binaural hearing system' refers to a system comprising two hearing aids and being adapted to cooperatively provide audible signals to both of the user's ears. Hearing systems or binaural hearing systems may further comprise one or more 'auxiliary devices', which communicate with the hearing aid(s) and affect and/or benefit from the function of the hearing aid(s). Auxiliary devices may be e.g. remote controls, audio gateway devices, mobile phones (e.g. SmartPhones), public-address systems, car audio systems or music players. Hearing aids, hearing systems or binaural hearing systems may e.g. be used for compensating for a hearing-impaired person's loss of hearing capability, augmenting or protecting a normal-hearing person's hearing capability and/or conveying electronic audio signals to a person.

Embodiments of the disclosure may e.g. be useful in applications such as hearing aids, headsets, ear phones, active ear protection systems or combinations thereof.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

FIG. 15B shows an embodiment of the pre-smoothing unit, and

FIG. 15C shows an embodiment of the variable smoothing unit (VarS) providing adaptively smoothed of covariance estimators $\overline{C}_{x11}(m)$, $\overline{C}_{x12}(m)$, and $\overline{C}_{x22}(m)$ according to the present disclosure.

FIGS. 16A, 16B, 16C and 16D illustrate a general embodiment of a variable time constant covariance estimator according to the present disclosure, wherein FIG. 16A schematically shows a covariance smoothing unit according to the present disclosure based on beamformed signals C1, C2.

FIG. 16B shows an embodiment of the pre-smoothing unit based on beamformed signals C1, C2, FIG. 16C shows an embodiment of the variable smoothing unit (VarS) adapted to the pres-smoothing unit of FIG. 16B, and FIG. 16D schematically illustrates the determination of β based on smoothed covariance matrices (<|C2|²>, <C1C2*>) according to the present disclosure;

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Figure 1:
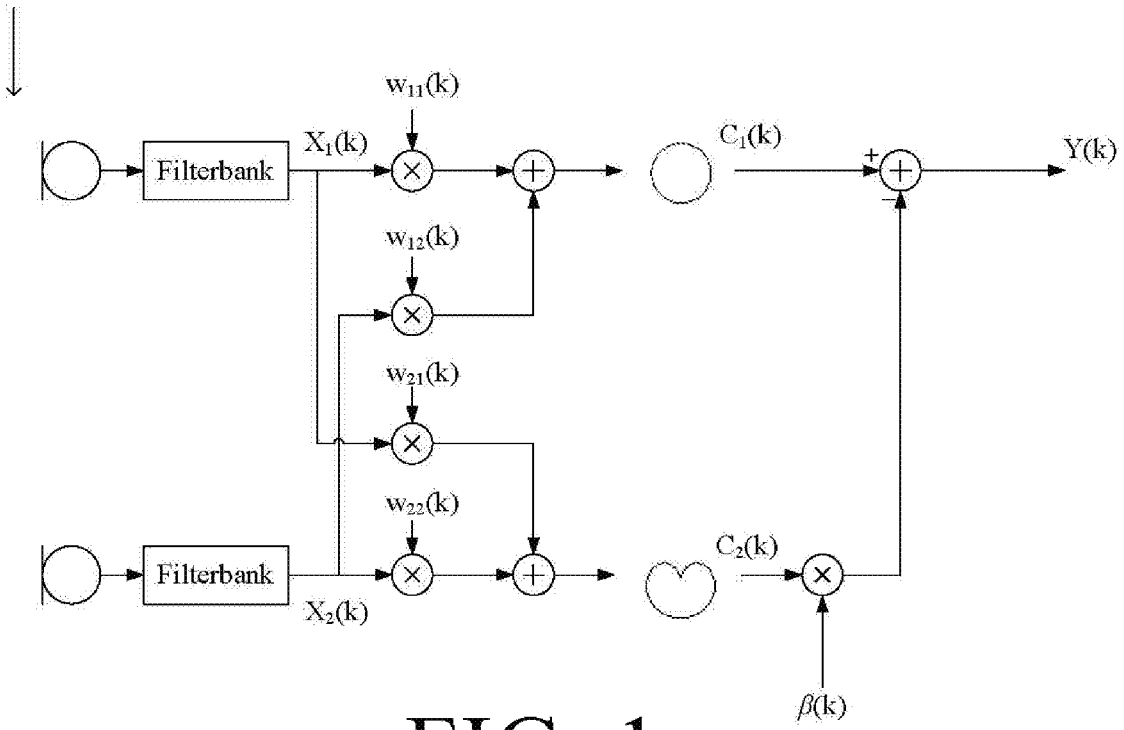
FIG. 1 shows an adaptive beam former configuration, where the adaptive beam former in the $k^{th}$ frequency channel Y(k) is created by subtracting a target cancelling beam former scaled by the adaptation factor β(k) from an omni-directional beam former.
Figure 2:
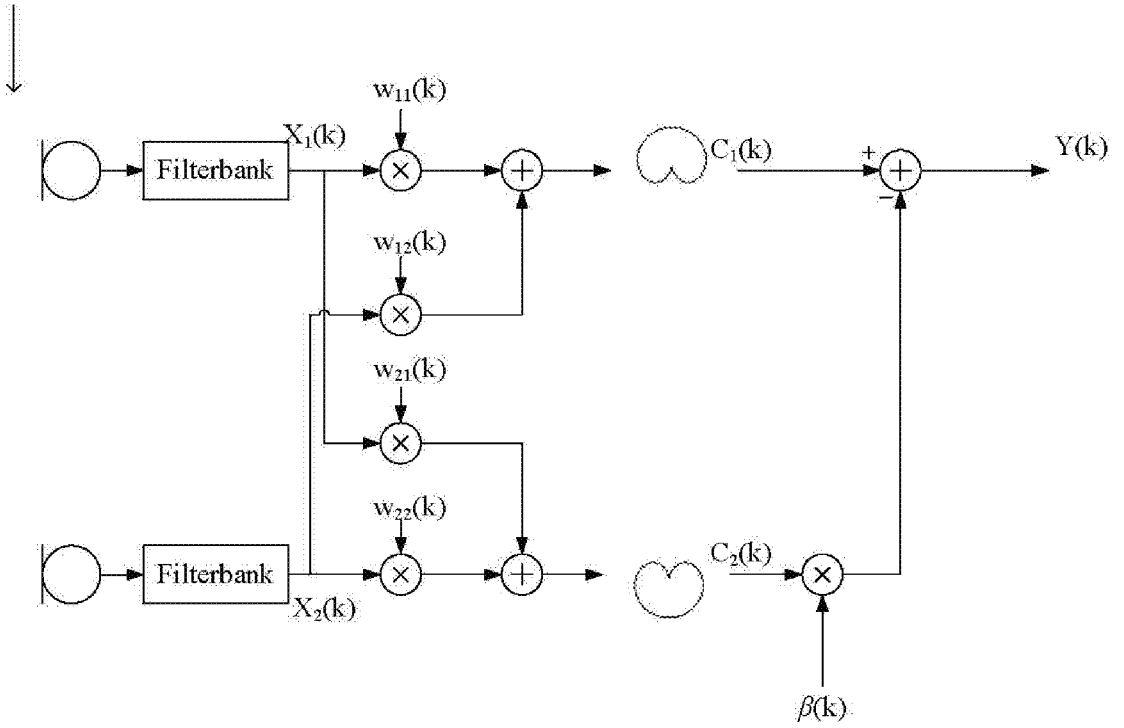
FIG. 2 shows an adaptive beam former configuration similar to the one shown in FIG. 1, but where the adaptive beam pattern Y(k) is created by subtracting a target cancelling beam former $C_2(k)$ scaled by the adaptation factor β(k) from another fixed beampattern $C_1(k)$.

The present application relates to the field of hearing aids, e.g. hearing aids. FIGS. 1 and 2 shows respective two-microphone beam former configurations for providing a spatially filtered (beamformed) signal Y(k) in a number K of frequency sub-bands k=1, 2, . . . , K. The frequency sub-band signals $X_1(k)$, $X_2(k)$ are provided by analysis filter banks (Filterbank) base don the respective (digitized) microphone signals. The two beam formers $C_1(k)$ and $C_2(k)$ are provided by respective combination units (multiplication units 'x' and summation unit '+') as (complex) linear combinations of the input signals:

$$C_1(k)=w_{11}(k)\cdot X_1(k)+w_{12}(k)\cdot X_2(k)$$

$$C_2(k)=w_{21}(k)\cdot X_1(k)+w_{22}(k)\cdot X_2(k)$$

FIG. 1 shows an adaptive beam former configuration, where the adaptive beam former in the $k^{th}$ frequency channel Y(k) is created by subtracting a target cancelling beam former $C_2(k)$ scaled by the adaptation factor β(k) from an omnidirectional beam former $C_1(k)$. In other words, $Y(k)=C_1(k)-\beta\cdot C_2(k)$. The two beam formers $C_1$, $C_2$ are preferably orthogonal in the sense that $[w_{11}\ w_{12}][w_{21}\ w_{22}]^H=0$.

FIG. 2 shows an adaptive beam former configuration similar to the one shown in FIG. 1, but where the adaptive beam pattern Y(k) is created by subtracting a target cancelling beam former $C_2(k)$ scaled by the adaptation factor β(k) from another fixed beampattern $C_1(k)$. Whereas the $C_1(k)$ in FIG. 1 is an omnidirectional beampattern, the beampattern here is a beam former with a null towards the opposite direction of $C_2(k)$ as indicated in FIG. 2 by cardioid symbols adjacent to the $C_1(k)$ and $C_2(k)$ references. Other sets of fixed beampatterns $C_1(k)$ and $C_2(k)$ may as well be used.

An adaptive beampattern (Y(k)), for a given frequency band k, is obtained by linearly combining two beam formers $C_1(k)$ and $C_2(k)$. $C_1(k)$ and $C_2(k)$ are different (possibly fixed) linear combinations of the microphone signals.

The beampatterns could e.g. be the combination of an omnidirectional delay-and-sum-beam former $C_1(k)$ and a delay-and-subtract-beam former $C_2(k)$ with its null direction pointing towards the target direction (target cancelling beam former) as shown in FIG. 1 or it could be two delay-and-subtract-beam formers as shown in FIG. 2, where the one $C_1(k)$ has maximum gain towards the target direction, and the other beam former is a target cancelling beam former. Other combinations of beam formers may as well be applied. Preferably, the beam formers should be orthogonal, i.e. $[w_{11} w_{12}][w_{21}\ w_{22}]^H=0$. The adaptive beampattern arises by scaling the target cancelling beam former $C_2(k)$ by a complex-valued, frequency-dependent, adaptive scaling factor $\beta(k)$ and subtracting it from the $C_1(k)$, i.e.

$$Y(k)=C_1(k)-\beta(k)C_2(k).$$

The beam former is adapted to work optimally in situations where the microphone signals consist of a point-noise target sound source in the presence of additive noise sources. Given this situation, the scaling factor $\beta(k)$ is adapted to minimize the noise under the constraint that the sound impinging from the target direction is unchanged. For each frequency band k, the adaptation factor $\beta(k)$ can be found in different ways. The solution may be found in closed form as $$\beta(k) = \frac{\langle C_2^* C_1 \rangle}{\langle |C_2|^2 \rangle + c}, \tag{1}$$

where * denote the complex conjugation and <·> denotes the statistical expectation operator, which may be approximated in an implementation as a time average. As an alternative, the adaptation factor may be updated by an LMS or NLMS equation:

$$\beta(n, k) = \beta(n-1, k) + \mu \frac{C_2^* Y - \alpha\beta(n-1, k)}{|C_2|^2},$$

In the following we omit the frequency channel index k. In (1), the adaptation factor $\beta$ is estimated by averaging across the input data. A simple way to average across data is by low-pass filtering the data as shown in FIG. 3.

Figure 3:
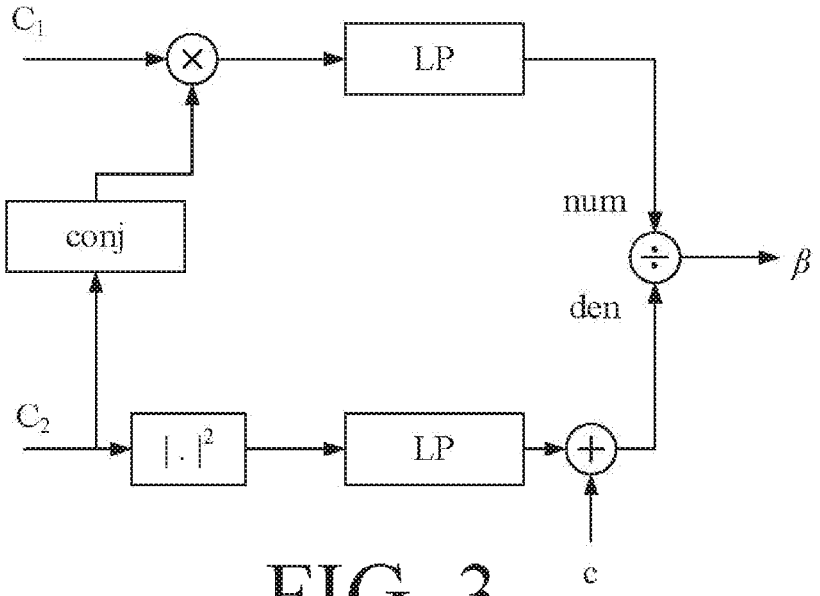
FIG. 3 shows an exemplary block diagram illustrating how the adaptation factor β is calculated from equation (1), which in the numerator contains the average value of $C_2^*\cdot C_1$ and in the denominator contains the average value of $C_2^*\cdot C_2=|C_2|^2$.

FIG. 3 shows a block diagram illustrating how the adaptation factor $\beta$ is calculated from equation (1), which in the numerator contains the average value of $C_2^* \cdot C_1$ and in the denominator contains the average value of $C_2^* C_2 = |C_2|^2$. We obtain the average value by low-pass filtering the two term. As $C_2^* C_1$ typically is complex-numbered, we low-pass filter the real and the imaginary part of $C_2^* C_1$ separately. In an embodiment, we low-pass filter the magnitude and the phase of $C_2^* C_1$ separately. The resulting adaptation factor $\beta$ is determined from input beam former signals $C_1$ and $C_2$ by appropriate functional units implementing the algebraic functions of equation (1), i.e. complex conjugation unit conj providing $C_2^*$ from input $C_2$, multiplication unit ('x') providing complex product $C_1 \cdot C_2^*$ from inputs $C_1$ and $C_2^*$. Magnitude squared unit $|\cdot|^2$ provides magnitude squared $|C_2|^2$ of input $C_2$. Complex and real valued sub-band signals $C_1 \cdot C_2^*$ and $|C_2|^2$, respectively, are low pass filtered by low pass filtering units LP to provide the resulting numerator and denominator in the expression for $\beta$ in equation (1) (the constant c being added to the real value of $|C_2|^2$ by summation unit '+' before or after the LP-filter (here after) to provide the expression for the denominator. The resulting adaptation factor $\beta$ is provided by division unit '·/·' based on inputs num (numerator) and den (denominator).

Figure 4:
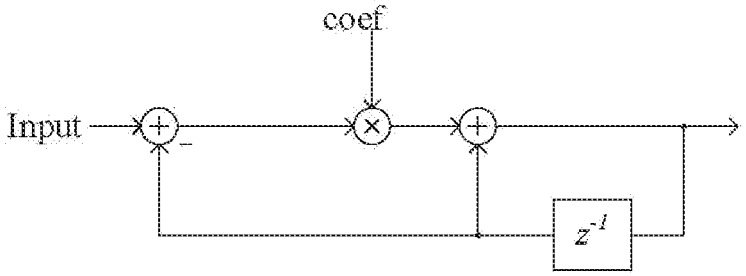
FIG. 4 shows a block diagram of a first order IIR filter, where the smoothing properties is controlled by a coefficient (coef)

Such a low-pass filter LP may e.g. be implemented by a first order IIR filter as shown in FIG. 4. The IIR filter is implemented by summation units '+' delay element $z^{-1}$ and multiplication unit 'x' for introducing a (possibly variable) smoothing element. FIG. 4 shows a first order IIR filter, where the smoothing properties is controlled by a coefficient (coef). The coefficient may take values between 0 and 1. A coefficient close to 0 applies averaging with a long time constant while a coefficient close to 1 applies a short time constant. In other words, if the coefficient is close to 1, only a small amount of smoothing is applied, while a coefficient close to 0 applies a higher amount of smoothing to the input signal. Averaging by a first order IIR filter have an exponential decay. As we apply smoothing on the inputs ($|C_2|^2$ and the real and imaginary part of $C_2^* C_1$), the convergence of the adaptation factor $\beta$ will be slow if the input level suddenly changes from a high level to a low level.

Figure 5A:
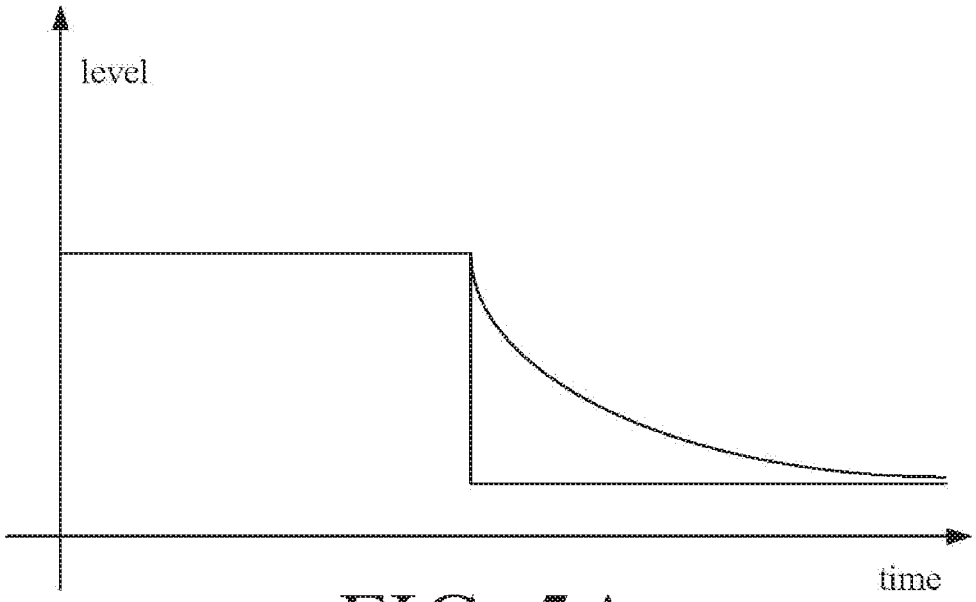
FIG. 5A shows an example of smoothing of the input signal $|C_2|^2$, wherein a long time constant will provide a stable estimate, but the convergence time will be slow, if the level suddenly changes from a high level to a low level.
Figure 5B:
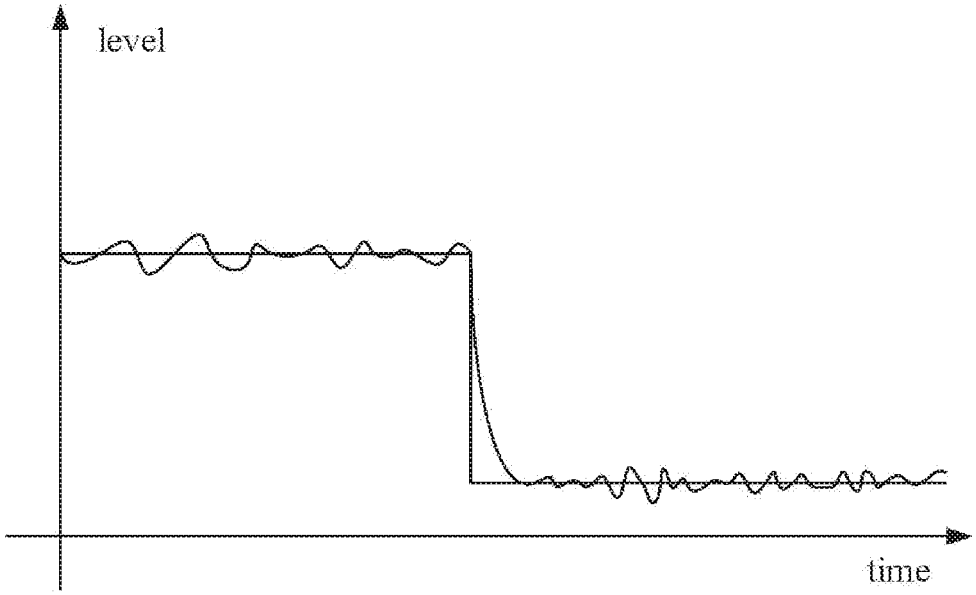
FIG. 5B shows an example of smoothing of the input signal $|C_2|^2$, wherein the time constant is short, and have a fast convergence, when the level changes, but the overall estimate has higher variance.

This is illustrated in FIGS. 5A and 5B showing a level (level) change from higher to lower and a corresponding time dependence (time) of a smoothed estimate depending on the smoothing coefficients of the LP-filter. FIG. 5A shows an example of smoothing of the input signal $|C_2|^2$, wherein a long time constant will provide a stable estimate, but the convergence time will be slow, if the level suddenly changes from a high level to a low level. By choosing a smaller time constant, a faster convergence can be achieved, but it the estimate will also have a higher variance. This is illustrated in FIG. 5B, which shows an example of smoothing of the input signal $|C_2|^2$, wherein the time constant is short, providing a fast convergence, when the level changes, but the overall estimate has higher variance.

We propose different ways to overcome this problem. A simple extension is to enable different attack and release coefficients in the low-pass filter. Such a low-pass filter is shown in FIG. 6.

Figure 6:
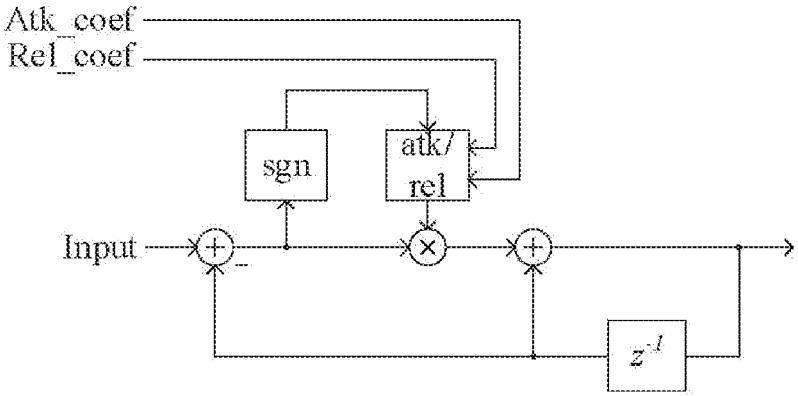
FIG. 6 shows a block diagram illustrating how the low-pass filter given in FIG. 4 may be implemented with different attack and release coefficients.

FIG. 6 shows a block diagram illustrating how the low-pass filter given in FIG. 4 may be implemented with different attack and release coefficients. The different time constants are applied depending on whether the input is increasing (attack) or decreasing (release). Hereby it is possible to adapt fast in case of a sudden level change. Different attack and release times will however result in a biased estimate.

Figure 7:
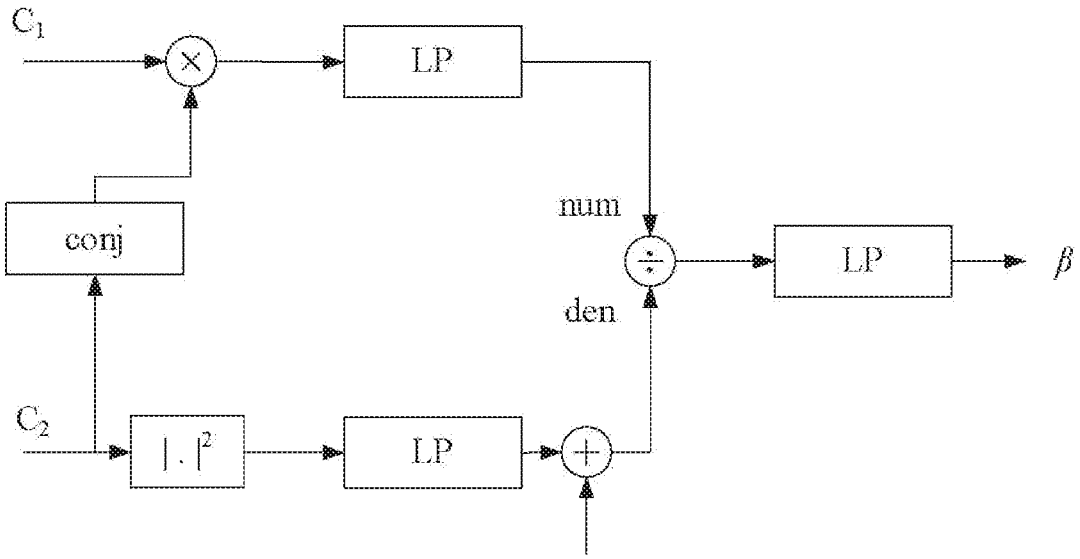
FIG. 7 shows an exemplary block diagram illustrating how the adaptation factor β is calculated from equation (1), but compared to FIG. 3, we do not only low-pass filter $C_2^*C_1$ and $|C_2|^2$, we also low-pass filter the calculated adaptation factor β.

FIG. 7 shows an exemplary block diagram illustrating how the adaptation factor $\beta$ is calculated from equation (1), but compared to FIG. 3, we do not only low-pass filter $C_2^* C_1$ and $|C_2|^2$, we also low-pass filter the calculated adaptation factor R. It has the advantage that while the average value of $C_2^* C_1$ and $|C_2|^2$ is sensitive to level drops, the low-pass filtering of $\beta$ is not. We may thus move parts of the smoothing from $C_2^* C_1$ and $|C_2|^2$ to $\beta$. Hereby we may allow more variance on the $(C_2^* C_1)$ and $\langle |C_2|^2 \rangle$ estimates by applying smaller time constants. We thus obtain a faster convergence in the case, where the input level suddenly decreases. In FIG. 7, we propose not only smoothing the numerator and denominator for the $\beta$-estimation. We also smooth the estimated value of $\beta$, i.e.

$$\beta(k) = \left\langle \frac{\langle C_2^* C_1 \rangle}{\langle |C_2|^2 \rangle + c} \right\rangle,$$

The advantage of smoothing the estimate of $\beta$ is that the estimate is less sensitive to sudden drops in input level. Consequently, we can apply a shorter time constant to the low-pass filters used in the numerator and the denominator of (1). Hereby we can adapt faster in case of a sudden decreasing level. By post-smoothing $\beta$, we cope with the increased estimation variance.

Another option is to apply an adaptive smoothing coefficient that changes if a sudden input level change is detected. Embodiments of such low-pass filters are shown in FIGS. 8A and 8B.

Figure 8A:
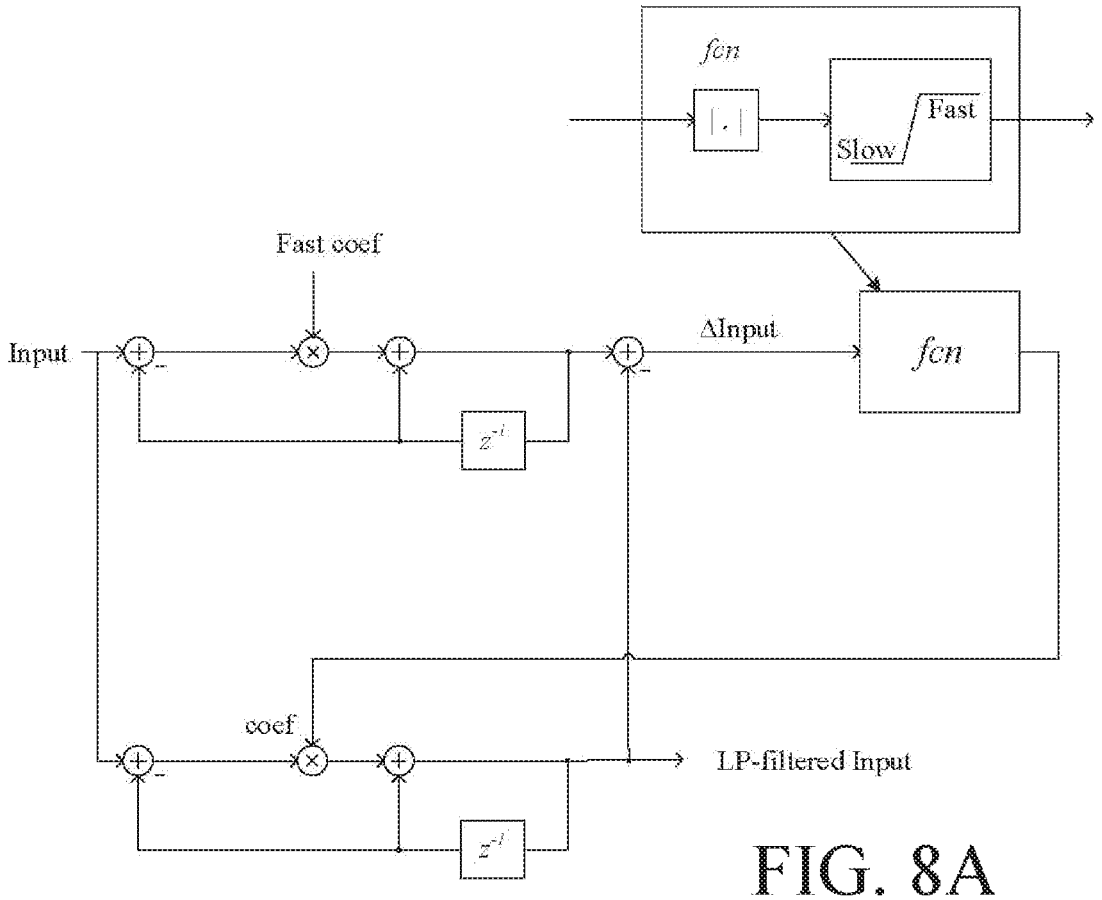
FIG. 8A shows a first exemplary block diagram of an improved low-pass filter.

FIG. 8A shows a first exemplary block diagram of an improved low-pass filter. The low-pass filter is able to change its time constant (or the equivalent coefficient (coef)) based on the difference between the input signal (Input) filtered by a low-pass filter (IIR-filter, cf. FIG. 4) having a (e.g. fixed) fast time constant and the input signal filtered by a low-pass filter having a (variable) slower time constant. If the difference ΔInput between the two low-pass filters is high, it indicates a sudden change of the input level. This change of input level will enable a change of the time constant of the low-pass filter with the slow time constant to a faster time constant (the mapping function shown in the function block (fcn) indicating a change from slow to fast adaptation (larger to smaller time constants) with increasing input signal difference ΔInput Hereby the low-pass filter will be able to adapt faster when we see sudden input level changes happen. If we only see small changes to the input level, a slower time constant is applied. By filtering the input signal by low-pass filters having different time constants (cf. LP-filtered Input) we will be able to detect when the level suddenly changes. Based on the level difference, we may adjust the coefficient by a non-linear function (*f*cn in FIG. 8A). In an embodiment the non-linear function changes between a slow and a fast time constant, if the absolute difference between the signals are greater than a given threshold. Whenever a sudden level change is detected, the smoothing coefficient changes from a slow time constant to a faster time constant, hereby allowing a fast convergence until the new input level is reached. When the estimate has converged, the time constant returns to its slower value. Hereby we obtain not only a fast convergence but also less variance on the estimate when the input level does not fluctuate. To allow the function unit to work on positive as well as negative level changes (a well as directly on a complex signal) the function unit comprises a magnitude unit |·| that precedes the ΔInput to time constant mapping function.

Figure 8B:
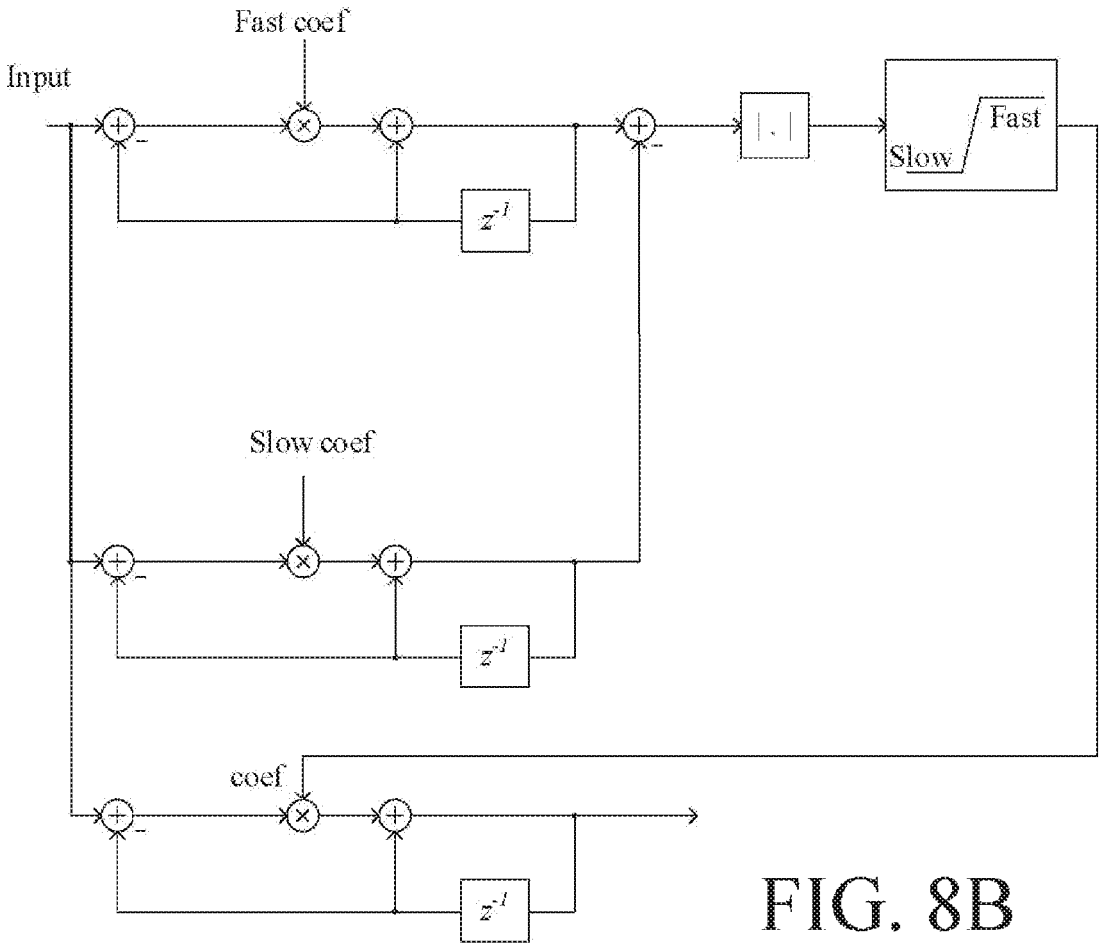
FIG. 8B shows a second exemplary block diagram of an improved low-pass filter.

FIG. 8B shows a second exemplary block diagram of an improved low-pass filter. The embodiment is similar to the embodiment of FIG. 8A, but the input difference signal is generated on the basis of two filtered signals with fixed fast and slow smoothing coefficients, and the resulting adapted smoothing coefficient (coef) is used to control the smoothing of a separate IIR filter that provides the LP-filtered input.

Figure 9:
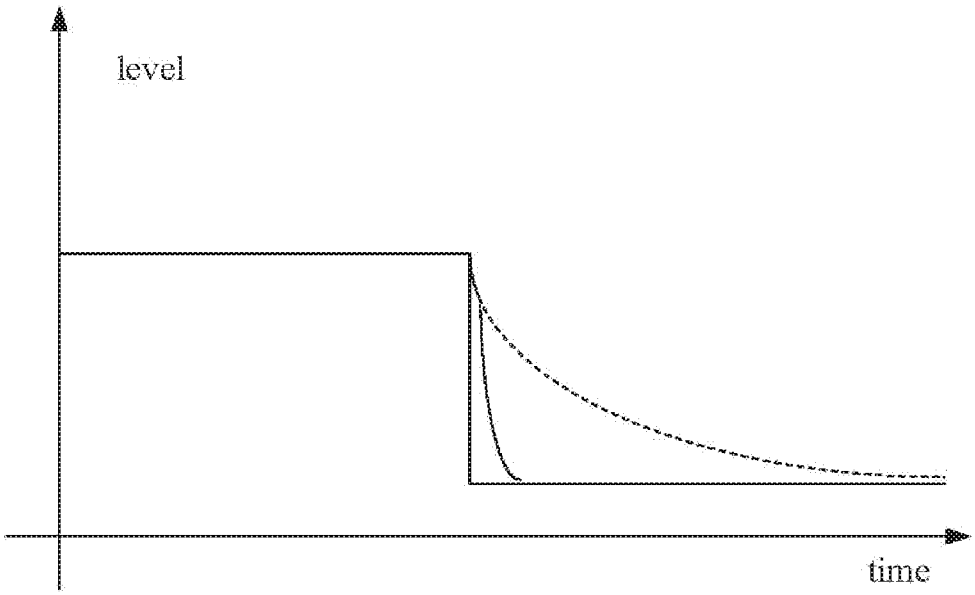
FIG. 9 shows the resulting estimate from the improved low-pass filter shown in FIG. 8A or 8B.

The resulting smoothing estimate from the low-pass filter shown in FIG. 8A or 8B is shown in FIG. 9. When an input level change is detected, the time constant is adapted to change from slow adaptation to a faster convergence (compared to the dashed line showing the slower convergence, cf. FIG. 5A). As soon as the estimate has adapted to the new level, the time constant is changed back to the slower value. Hereby we obtain faster convergence (compared to the dashed line showing the convergence using the slower time constant).

Figure 10:
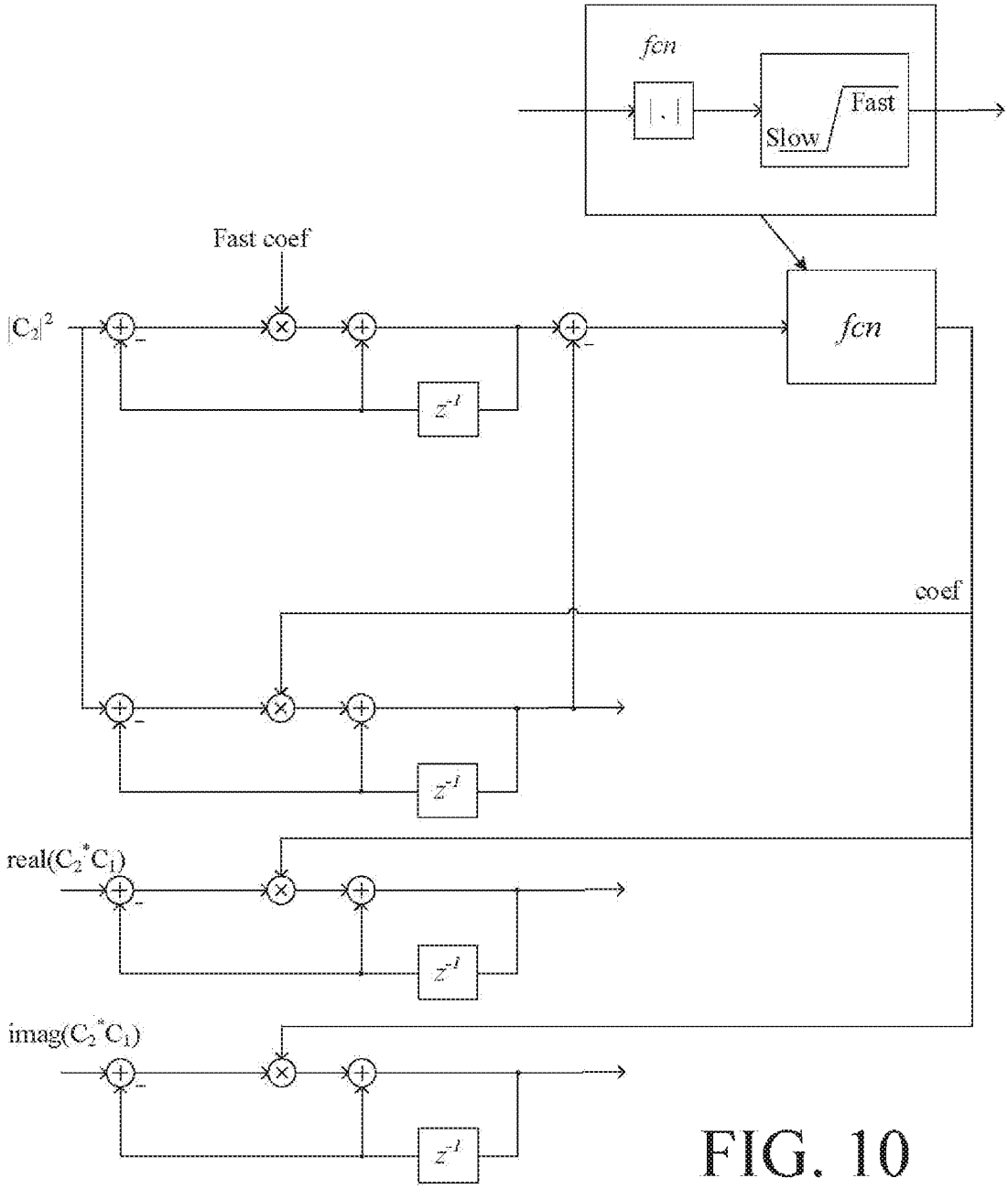
FIG. 10 shows an exemplary block diagram of an improved low-pass filter with a similar low-pass filter structure as in FIG. 8A, but in FIG. 10, the adaptive coefficient depends on the level changes of $|C_2|^2$.

FIG. 10 shows an exemplary block diagram of an improved low-pass filter with a similar low-pass filter structure as in FIG. 8A, but in FIG. 10, the adaptive coefficient depends on the level changes of $|C_2|^2$. When low-pass filtering the numerator and the denominator of Equation (1), it is important that the same time constant is applied in both the numerator and the denominator. Here we propose that the adaptive coefficient depends on the level changes of $|C_2|^2$. In FIG. 10, the adaptive time constant is used as coefficient for the slow low-pass filter.

Figure 11:
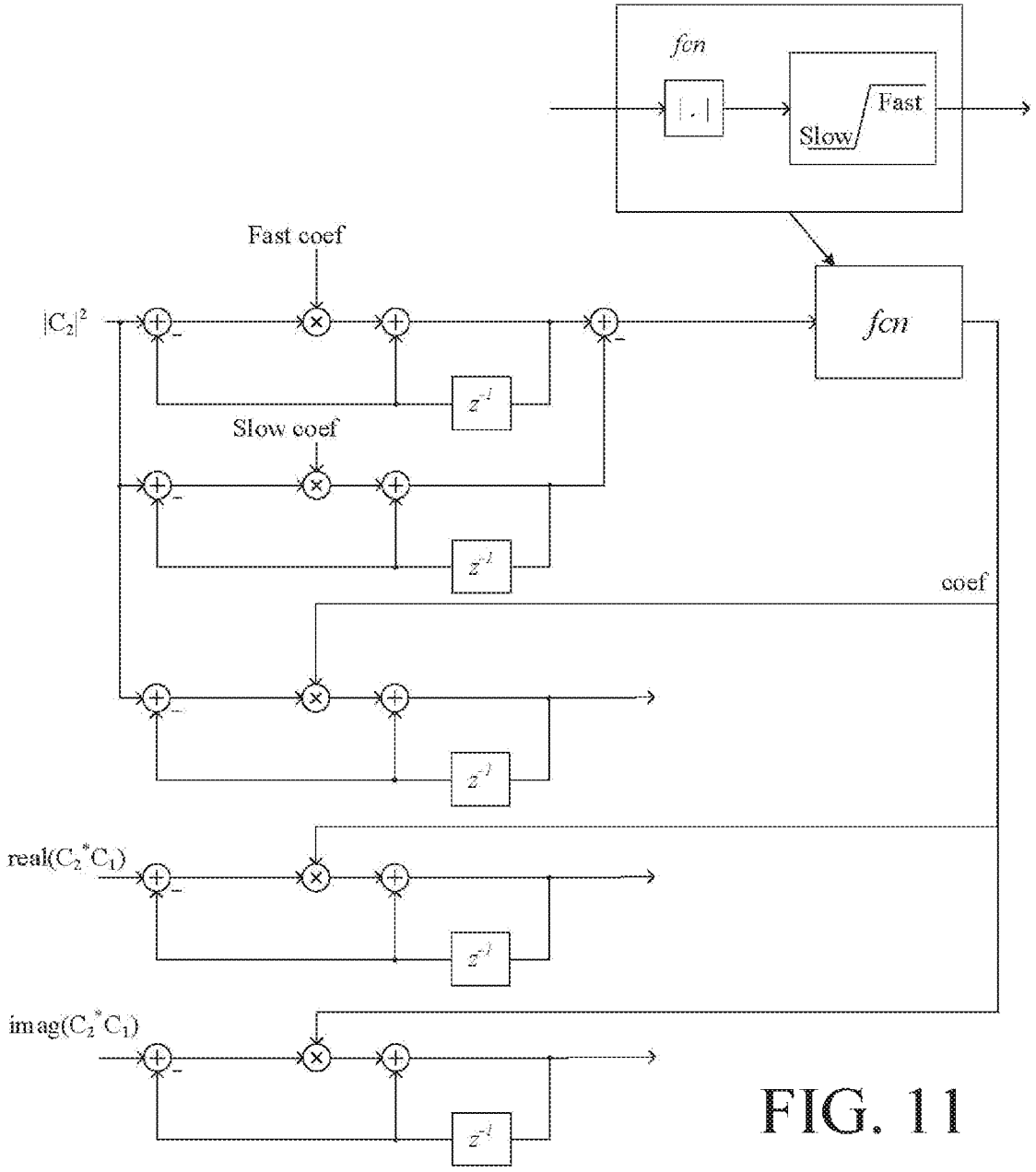
FIG. 11 shows an exemplary block diagram of an improved low-pass filter with a similar low-pass filter structure as in FIG. 10, but in the embodiment of FIG. 11 the adaptive coefficient (coef) is estimated from a difference between two low-pass filtered estimates of $|C_2|^2$ with fixed slow and fast time constants, respectively.

FIG. 11 shows an exemplary block diagram of an improved low-pass filter with a similar low-pass filter structure as in FIG. 10, but in the embodiment of FIG. 11 the adaptive coefficient (coef) is estimated from a difference between two low-pass filtered estimates of $|C_2|^2$ with fixed slow and fast time constants, respectively (cf. FIG. 8B). In FIG. 11, separate low-pass filters with fixed fast and fixed slow time constants are used to estimate the adaptive coefficient. Also other factors may be used to control the coefficient of the low-pass filters. E.g. a voice activity detector may be used to halt the update (by setting the coefficient to 0). In that case, the adaptive coefficient is solely updated during speech pauses.

Figure 12:
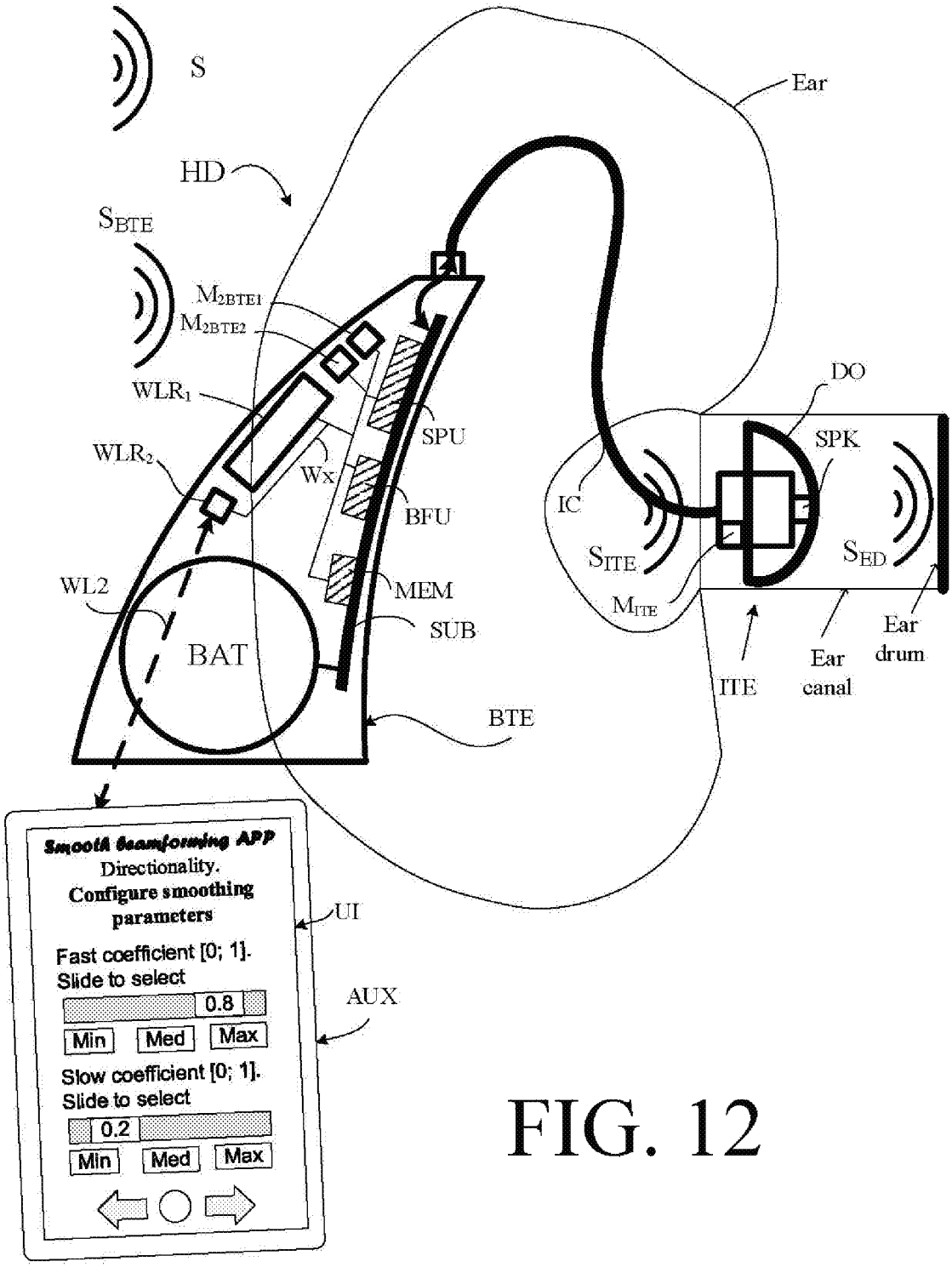
FIG. 12 shows an embodiment of a hearing aid according to the present disclosure comprising a BTE-part located behind an ear or a user and an ITE part located in an ear canal of the user.

FIG. 12 shows an embodiment of a hearing aid according to the present disclosure comprising a BTE-part located behind an ear or a user and an ITE part located in an ear canal of the user.

Figure 13A:
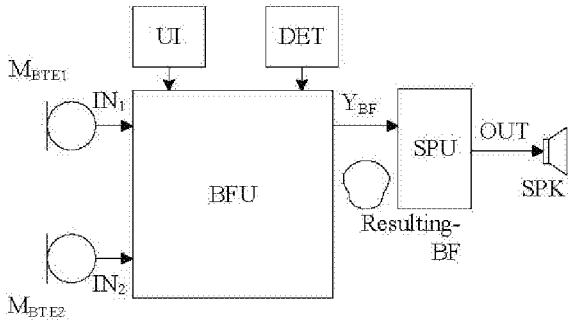
FIG. 13A shows a block diagram of a first embodiment of a hearing aid according to the present disclosure.
Figure 13B:
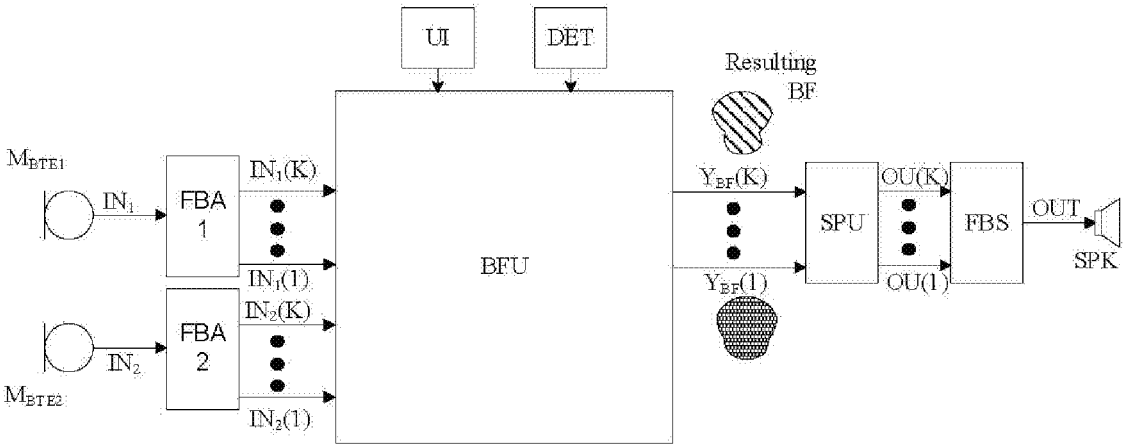
FIG. 13B shows a block diagram of a second embodiment of a hearing aid according to the present disclosure.

FIG. 12 illustrates an exemplary hearing aid (HD) formed as a receiver in the ear (RITE) type hearing aid comprising a BTE-part (BTE) adapted for being located behind pinna and a part (ITE) comprising an output transducer (e.g. a loudspeaker/receiver, SPK) adapted for being located in an ear canal (Ear canal) of the user (e.g. exemplifying a hearing aid (HD) as shown in FIG. 13A, 13B). The BTE-part (BTE) and the ITE-part (ITE) are connected (e.g. electrically connected) by a connecting element (IC). In the embodiment of a hearing aid of FIG. 12, the BTE part (BTE) comprises two input transducers (here microphones) ($M_{BTE1}$, $M_{BTE2}$) each for providing an electric input audio signal representative of an input sound signal ($S_{BTE}$) from the environment. In the scenario of FIG. 12, the input sound signal $S_{BTE}$ includes a contribution from sound source S, S being e.g. sufficiently far away from the user (and thus from hearing device HD) so that its contribution to the acoustic signal $S_{BTE}$ is in the acoustic far-field. The hearing aid of FIG. 12 further comprises two wireless receivers ($WLR_1$, $WLR_2$) for providing respective directly received auxiliary audio and/or information signals. The hearing aid (HD) further comprises a substrate (SUB) whereon a number of electronic components are mounted, functionally partitioned according to the application in question (analogue, digital, passive components, etc.), but including a configurable signal processing unit (SPU), a beam former filtering unit (BFU), and a memory unit (MEM) coupled to each other and to input and output units via electrical conductors Wx. The mentioned functional units (as well as other components) may be partitioned in circuits and components according to the application in question (e.g. with a view to size, power consumption, analogue vs. digital processing, etc.), e.g. integrated in one or more integrated circuits, or as a combination of one or more integrated circuits and one or more separate electronic components (e.g. inductor, capacitor, etc.). The configurable signal processing unit (SPU) provides an enhanced audio signal (cf. signal OUT in FIG. 13A, 13B), which is intended to be presented to a user. In the embodiment of a hearing aid device in FIG. 12, the ITE part (ITE) comprises an output unit in the form of a loudspeaker (receiver) (SPK) for converting the electric signal (OUT) to an acoustic signal (providing, or contributing to, acoustic signal $S_{ED}$ at the ear drum (Ear drum). In an embodiment, the ITE-part further comprises an input unit comprising an input transducer (e.g. a microphone) ($M_{ITE}$) for providing an electric input audio signal representative of an input sound signal $S_{ITE}$ from the environment (including from sound source S) at or in the ear canal. In another embodiment, the hearing aid may comprise only the BTE-microphones ($M_{BTE1}$, $M_{BTE2}$). In another embodiment, the hearing aid may comprise only the ITE-microphone ($M_{ITE}$). In yet another embodiment, the hearing aid may comprise an input unit ($IT_3$) located elsewhere than at the ear canal in combination with one or more input units located in the BTE-part and/or the ITE-part. The ITE-part further comprises a guiding element, e.g. a dome, (DO) for guiding and positioning the ITE-part in the ear canal of the user.

The hearing aid (HD) exemplified in FIG. 12 is a portable device and further comprises a battery (BAT) for energizing electronic components of the BTE- and ITE-parts.

The hearing aid (HD) comprises a directional microphone system (beam former filtering unit (BFU)) adapted to enhance a target acoustic source among a multitude of acoustic sources in the local environment of the user wearing the hearing aid device. In an embodiment, the directional system is adapted to detect (such as adaptively detect) from which direction a particular part of the microphone signal (e.g. a target part and/or a noise part) originates. In an embodiment, the beam former filtering unit is adapted to receive inputs from a user interface (e.g. a remote control or a smartphone) regarding the present target direction. The memory unit (MEM) may e.g. comprise predefined (or adaptively determined) complex, frequency dependent constants ($W_{ij}$) defining predefined or (or adaptively determined) 'fixed' beam patterns (e.g. omni-directional, target cancelling, etc.), together defining the beamformed signal $Y_{BF}$ (cf. e.g. FIG. 13A, 13B).

The hearing aid of FIG. 12 may constitute or form part of a hearing aid and/or a binaural hearing aid system according to the present disclosure.

The hearing aid (HD) according to the present disclosure may comprise a user interface UI, e.g. as shown in FIG. 12 implemented in an auxiliary device (AUX), e.g. a remote control, e.g. implemented as an APP in a smartphone or other portable (or stationary) electronic device. In the embodiment of FIG. 12, the screen of the user interface (UI) illustrates a Smooth beamforming APP. Parameters that govern or influence the current smoothing of adaptive beamforming, here fast and slow smoothing coefficients of low pass filters involved in the determination of the adaptive beamformer parameter β (cf. discussion in connection with FIG. 8A, 8B, and FIG. 10, 11) can be controlled via the Smooth beamforming APP (with the subtitle: 'Directionality. Configure smoothing parameters'). The smoothing parameters 'Fast coefficient' and 'Slow coefficient' can be set via respective sliders to a value between a minimum value (0) and a maximum value (1). The currently set values (here 0.8 and 0.2, respectively) are shown on the screen at the location of the slider on the (grey shaded) bar that span the configurable range of values. The coefficients could as well be shown as derived parameters such as time constants or other descriptions such as "calm" or "aggressive". The coefficient can be derived from the time constant as $coef=1-\exp(-1/(f_s*\tau))$, where $f_s$ is the sample rate of the time frame, and τ is a time constant. The arrows at the bottom of the screen allow changes to a preceding and a proceeding screen of the APP, and a tab on the circular dot between the two arrows brings up a menu that allows the selection of other APPs or features of the device.

The auxiliary device and the hearing aid are adapted to allow communication of data representative of the currently selected direction (if deviating from a predetermined direction (already stored in the hearing aid)) to the hearing aid via a, e.g. wireless, communication link (cf. dashed arrow WL2 in FIG. 12). The communication link WL2 may e.g. be based on far field communication, e.g. Bluetooth or Bluetooth Low Energy (or similar technology), implemented by appropriate antenna and transceiver circuitry in the hearing aid (HD) and the auxiliary device (AUX), indicated by transceiver unit $WLR_2$ in the hearing aid.

FIG. 13A shows a block diagram of a first embodiment of a hearing aid according to the present disclosure. The hearing aid of FIG. 13A may e.g. comprise a 2-microphone beam former configuration as e.g. shown in FIG. 1, 2, and a signal processing unit (SPU) for (further) processing the beamformed signal $Y_{BF}$ and providing a processed signal OUT. The signal processing unit may be configured to apply a level and frequency dependent shaping of the beamformed signal, e.g. to compensate for a user's hearing impairment. The processed signal (OUT) is fed to an output unit for presentation to a user as a signal perceivable as sound. In the embodiment of FIG. 13A, the output unit comprises a loudspeaker (SPK) for presenting the processed signal (OUT) to the user as sound. The forward path from the microphones to the loudspeaker of the hearing aid may be operated in the time domain. The hearing aid may further comprise a user interface (UI) and one or more detectors (DET) allowing user inputs and detector inputs (e.g. from a user interface as illustrated in FIG. 12) to be received by the beam former filtering unit (BFU). Thereby an adaptive functionality of the resulting adaptation parameter β may be provided.

FIG. 13B shows a block diagram of a second embodiment of a hearing aid according to the present disclosure. The hearing aid of FIG. 13B is similar in functionality to the hearing aid of FIG. 13A, also comprising a 2-microphone beam former configuration as e.g. shown in FIG. 1, 2, but the signal (where time-domain input signals $IN_1$ and $IN_2$ are provided as frequency sub-band signals $IN_1(k)$ and $IN_2(k)$, respectively, where k=1, 2, . . . , K, by respective analysis filter banks FBA1 and FBA2. Hence, the processing unit (SPU) for (further) processing the beamformed signal $Y_{BF}(k)$ is configured to process the beamformed signal $Y_{BF}(k)$ in a number (K) of frequency bands and providing processed (sub-band) signals OU(k), k=1, 2, . . . , K. The signal processing unit may be configured to apply a level and frequency dependent shaping of the beamformed signal, e.g. to compensate for a user's hearing impairment (and/or a challenging acoustic environment). The processed frequency band signals OU(k) are fed to a synthesis filter bank FBS for converting the frequency band signals OU(k) to a single time-domain processed (output) signal OUT, which is fed to an output unit for presentation to a user as a stimulus perceivable as sound. In the embodiment of FIG. 13B, the output unit comprises a loudspeaker (SPK) for presenting the processed signal (OUT) to the user as sound. The forward path from the microphones ($M_{BTE1}$, $M_{BTE2}$) to the loudspeaker (SPK) of the hearing aid is (mainly) operated in the time-frequency domain (in K frequency sub-bands).

Figure 14:
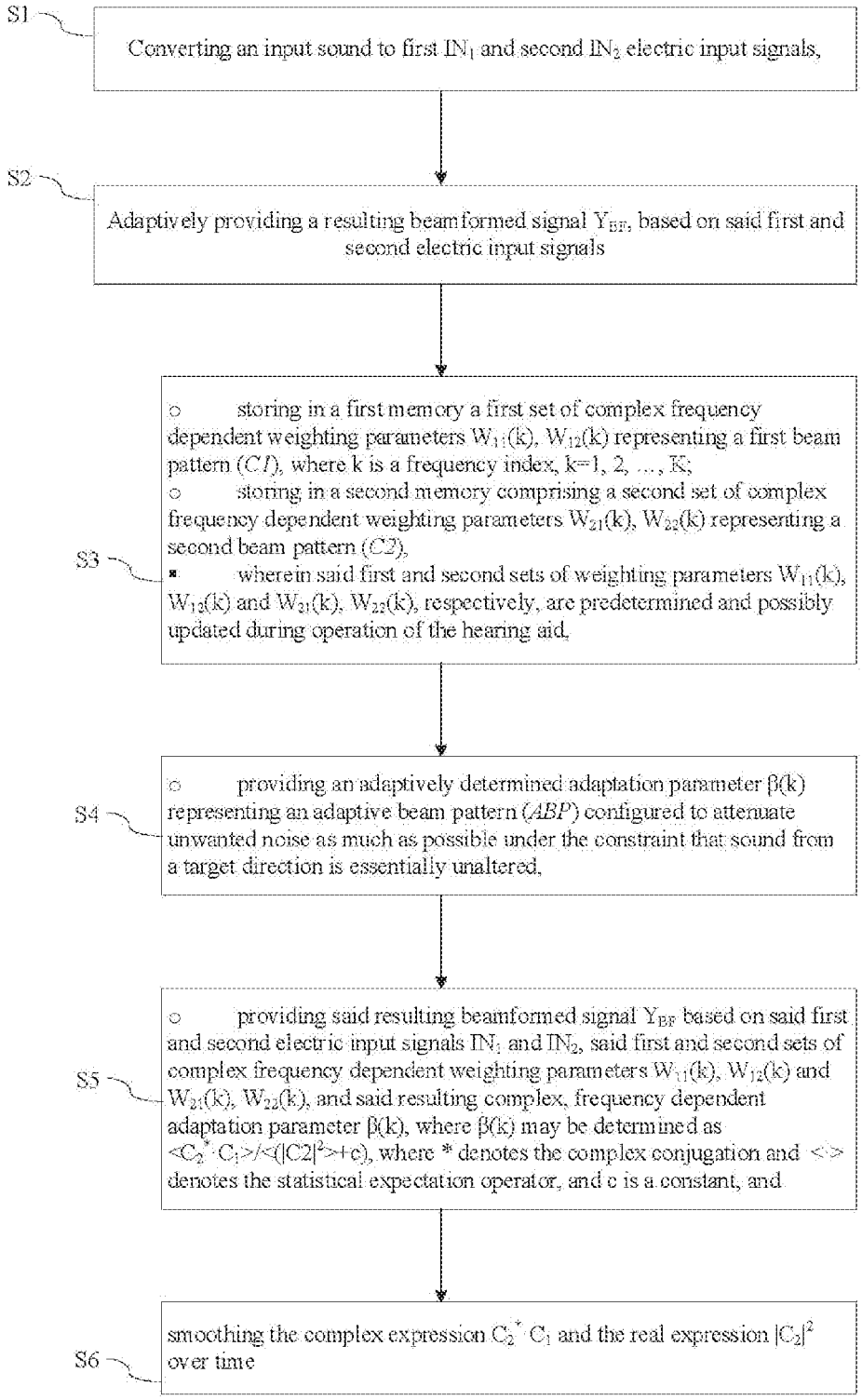
FIG. 14 shows a flow diagram of a method of operating an adaptive beam former for providing a resulting beamformed signal $Y_{BF}$ of a hearing aid according to an embodiment of the present disclosure.

FIG. 14 shows a flow diagram of a method of operating an adaptive beam former for providing a resulting beamformed signal $Y_{BF}$ of a hearing aid according to an embodiment of the present disclosure.

The method is configured to operate a hearing aid adapted for being located in an operational position at or in or behind an ear or fully or partially implanted in the head of a user.

The Method Comprises

S1. converting an input sound to first $IN_1$ and second $IN_2$ electric input signals, S2. adaptively providing a resulting beamformed signal $Y_{BF}$, based on said first and second electric input signals;

S3. storing in a first memory a first set of complex frequency dependent weighting parameters $W_{11}(k)$, $W_{12}(k)$ representing a first beam pattern (C1), where k is a frequency index, k=1, 2, . . . , K; storing in a second memory comprising a second set of complex frequency dependent weighting parameters $W_{21}(k)$, $W_{22}(k)$ representing a second beam pattern (C2), wherein said first and second sets of weighting parameters $W_{11}(k)$, $W_{12}(k)$ and $W_{21}(k)$, $W_{22}(k)$, respectively, are predetermined and possibly updated during operation of the hearing aid, S4. providing an adaptively determined adaptation parameter β(k) representing an adaptive beam pattern (ABP) configured to attenuate unwanted noise as much as possible under the constraint that sound from a target direction is essentially unaltered, and S5. providing said resulting beamformed signal $Y_{BF}$ based on said first and second electric input signals $IN_1$ and $IN_2$, said first and second sets of complex frequency dependent weighting parameters $W_{11}(k)$, $W_{12}(k)$ and $W_{21}(k)$, $W_{22}(k)$, and said resulting complex, frequency dependent adaptation parameter β(k), where β(k) may be determined as $$\beta(k) = \frac{\langle C_2^* C_1 \rangle}{\langle |C_2|^2 \rangle + c},$$

where * denotes the complex conjugation and ⟨⟩ denotes the statistical expectation operator, and c is a constant S6. smoothing the complex expression $C_2^* \cdot C_1$ and the real expression $|C_2|^2$ over time.

A method of Adaptive Covariance Matrix Smoothing for Accurate Target Estimation and Tracking.

In a further aspect of the present disclosure, a method of adaptively smoothing covariance matrices is outlined in the following. A particular use of the scheme is for (adaptively) estimating a direction of arrival of sound from a target sound source to a person (e.g. a user of a hearing aid, e.g. a hearing aid according to the present disclosure).

The method is exemplified as an alternative scheme for smoothing of the adaptation parameter β(k) according to the present disclosure (cf. FIGS. 16A-16D and 17A, 17B).

Signal Model:

We consider the following signal model of the signal x impinging on the $i^{th}$ microphone of a microphone array consisting of M microphones:

$$x_i(n)=s_i(n)+v_i(n), \tag{1}$$

where s is the target signal, v is the noise signal, and n denotes the time sample index. The corresponding vector notation is $$x(n)=s(n)+v(n), \tag{2}$$

where $x(n)=[x_1(n); x_2(n), \ldots, x_M(n)]^T$. In the following, we consider the signal model in the time frequency domain. The corresponding model is thus given by $$X(k,m)=S(k,m)+V(k,m), \tag{3}$$

where k denotes the frequency channel index and m denotes the time frame index. Likewise $X(k,m)=[X_1(k,m), X_2(k,m), \ldots, X_M(k,m)]^T$. The signal at the $i^{th}$ microphone, $x_i$ is a linear mixture of the target signal $s_i$ and the noise $v_i$, $v_i$ is the sum of all noise contributions from different directions as well as microphone noise. The target signal at the reference microphone $s_{ref}$ is given by the target signal s convolved by the acoustic transfer function h between the target location and the location of the reference microphone. The target signal at the other microphones is thus given by the target signal at the reference microphone convolved by the relative transfer function $d=[1, d_2, \ldots, d_M]^T$ between the microphones, i.e. $s_i=s*h*d_1$. The relative transfer function d depends on the location of the target signal. As this is typically the direction of interest, we term d the look vector. At each frequency channel, we thus define a target power spectral density $\sigma_s^2(k,m)$ at the reference microphone, i.e.

$$\sigma_s^2(k,m)=\langle |S(k,m)H(k,m)|^2 \rangle = \langle S(k,m)_{ref}|^2 \rangle, \tag{4}$$

where ⟨⟩ denotes the expected value. Likewise, the noise spectral power density at the reference microphone is given by $$\sigma_v^2(k,m)=\langle |V(k,m)_{ref}|^2 \rangle, \tag{5}$$

The inter-microphone cross-spectral covariance matrix at the $k^{th}$ frequency channel for the clean signal s is then given by $$C_s(k,m)=\sigma_s^2(k,m)d(k,m)d^H(k,m), \tag{6}$$

where H denotes Hermitian transposition. We notice the M×M matrix $C_s(k,m)$ is a rank 1 matrix, as each column of $C_s(k,m)$ is proportional to d(k,m). Similarly, the inter-microphone cross-power spectral density matrix of the noise signal impinging on the microphone array is given by, $$C_v(k,m)=\sigma_v^2(k,m)\Gamma(k,m_0), m>m_0, \tag{7}$$

where $\Gamma(k, m_0)$ is the M×M noise covariance matrix of the noise, measured some time in the past (frame index $m_0$). Since all operations are identical for each frequency channel index, we skip the frequency index k for notational convenience wherever possible in the following. Likewise, we skip the time frame index m, when possible. The inter-microphone cross-power spectral density matrix of the noisy signal is then given by $$C=C_s+C_v \tag{8}$$

$$C=\sigma_s^2 dd^H+\sigma_v^2\Gamma \tag{9}$$

where the target and noise signals are assumed to be uncorrelated. The fact that the first term describing the target signal, $C_s$, is a rank-one matrix implies that the beneficial part (i.e., the target part) of the speech signal is assumed to be coherent/directional. Parts of the speech signal, which are not beneficial, (e.g., signal components due to late-reverberation, which are typically incoherent, i.e., arrive from many simultaneous directions) are captured by the second term.

Covariance Matrix Estimation

A look vector estimate can be found efficiently in the case of only two microphones based on estimates of the noisy input covariance matrix and the noise only covariance matrix. We select the first microphone as our reference microphone. Our noisy covariance matrix estimate is given by $$\hat{C} = \begin{bmatrix} \hat{C}_{x11} & \hat{C}_{x12} \\ \hat{C}_{x12}^* & \hat{C}_{x22} \end{bmatrix} \tag{10}$$

where * denotes complex conjugate. Each element of our noisy covariance matrix is estimated by low-pass filtering the outer product of the input signal, $XX^H$. We estimate each element by a first order IIR low-pass filter with the smoothing factor αε[0], i.e.

$$\hat{C}_x(m) = \begin{cases} \alpha\hat{C}_x(m-1) + (1-\alpha)X(m)X(m)^H, \text{ Target present;} \\ \gamma\hat{C}_x(m-1) + (1-\gamma)\hat{C}_{no}, \text{ Otherwise} \end{cases} \quad (11)$$

We thus need to low-pass filter four different values (two real and one complex value), i.e. $\hat{C}_{x11}(m)$, $\mathrm{Re}\{\hat{C}_{x12}(m)\}$, $\mathrm{Im}\{\hat{C}_{x12}(m)\}$, and $\hat{C}_{x22}(m)$. We don't need $\hat{C}_{x21}(m)$ since $\hat{C}_{x21}(m)=\hat{C}_{x12}^*$. It is assumed that the target location does not change dramatically in speech pauses, i.e. it is beneficial to keep target information from previous speech periods using a slow time constant giving accurate estimates. This means that $\hat{C}_x$ is not always updated with the same time constant and does not converge to $\hat{C}_v$ in speech pauses, which is normally the case. In long periods with speech absence, the estimate will (very slowly) converge towards to $C_{no}$ using a smoothing factor close to one. The covariance matrix $C_{no}$ could represent a situation where the target DOA is zero degrees (front direction), such that the system prioritizes the front direction when speech is absent. $C_{no}$ may e.g. be selected as an initial value of $C_x$.

In a similar way, we estimate the elements in the noise covariance matrix, in that case $$\hat{C}_v(m) = \begin{cases} \alpha_v\hat{C}_v(m-1) + (1-\alpha_v)X(m)X(m)^H, \text{ Noise only;} \\ \hat{C}_v(m-1), \text{ Otherwise} \end{cases} \quad (12)$$

The noise covariance matrix is updated when only noise is present. Whether the target is present or not may be determined by a modulation-based voice activity detector. It should be noted that "Target present" (cf. FIG. 15C) is not necessarily the same as the inverse of "Noise Only". The VAD indicators controlling the update could be derived from different thresholds on momentary SNR or Modulation Index estimates.

Adaptive Smoothing

The performance of look vector estimation is highly dependent on the choice of smoothing factor $\alpha$, which controls the update rate of $\hat{C}_x(m)$. When $\alpha$ is close to zero, an accurate estimate can be obtained in spatially stationary situations. When $\alpha$ is close to 1, estimators will be able to track fast spatial changes, for example when tracking two talkers in a dialogue situation. Ideally, we would like to obtain accurate estimates and fast tracking capabilities which is a contradiction in terms of the smoothing factor and there is a need to find a good balance. In order to simultaneously obtain accurate estimates in spatially stationary situations and fast tracking capabilities, an adaptive smoothing scheme is proposed.

In order to control a variable smoothing factor, the normalized covariance $$\rho(m)=C_{x11}^{-1}C_{x12}, \quad (13)$$

can be observed an indicator for changes in the target DOA (where $C_{x11}^{-1}$ and $C_{x12}$ are complex numbers).

In a practical implementation, e.g. a portable device, such as hearing aid, we prefer to avoid the division and reduce the number of computations, so we propose the following log normalized covariance measure $$\rho(m)=\Sigma_k\{\log(\max\{0,\mathrm{Im}\{\hat{C}_{x12}\}+1\})-\log(\hat{C}_{x11})\}, \quad (14)$$

Two instances of the (log) normalized covariance measure are calculated, a fast instance $\tilde{\rho}(m)$ and an instance $\overline{\rho}(m)$ with variable update rate. The fast instance $\tilde{\rho}(m)$ is based on the fast variance estimate $$\tilde{C}_{x11}(m) = \begin{cases} \tilde{\alpha}\hat{C}_{x11}(m-1) + (1-\tilde{\alpha})X(m)X(m)^H, \text{ Target present;} \\ \tilde{C}_{x11}(m-1), \text{ Target absent} \end{cases} \quad (15)$$

where $\tilde{\alpha}$ is a fast time constant smoothing factor, and the corresponding fast covariance estimate $$\tilde{C}_{x12}(m) = \begin{cases} \tilde{\alpha}\tilde{C}_{x12}(m-1) + (1-\tilde{\alpha})X(m)X(m)^H, \text{ Target present;} \\ \tilde{C}_{x12}(m-1), \text{ Target absent} \end{cases} \quad (16)$$

according to $$\rho(m)=\Sigma_k\{\log(\max\{0\mathrm{Im}\{\tilde{C}_{x12}\}+1\})-\log(\tilde{C}_{x11})\}, \quad (17)$$

Similar expressions for the instance with variable update rate $\overline{\rho}(m)$, based on equivalent estimators $\overline{C}_{x11}(m)$ and $\overline{C}_{x12}(m)$ using a variable smoothing factor $\overline{\alpha}(m)$ can be written:

$$\overline{C}_{x11}(m) = \begin{cases} \overline{\alpha}\overline{C}_{x11}(m-1) + (1-\overline{\alpha})X(m)X(m)^H, \text{ Target present;} \\ \overline{C}_{x11}(m-1), \text{ Target absent} \end{cases} \quad (15')$$

where $\tilde{a}$ is a fast time constant smoothing factor, and the corresponding fast covariance estimate $$\overline{C}_{x12}(m) = \begin{cases} \overline{\alpha}\overline{C}_{x12}(m-1) + (1-\overline{\alpha})X(m)X(m)^H, \text{ Target present;} \\ \overline{C}_{x12}(m-1), \text{ Target absent} \end{cases} \quad (16')$$

according to $$\rho(m)=\Sigma_k\{\log(\max\{0,\mathrm{Im}\{\overline{C}_{x12}\{+1\})-\log(\overline{C}_{x11})\}, \quad (17')$$

The smoothing factor $\overline{\alpha}$ of the variable estimator is changed to fast when the normalized covariance measure of the variable estimator deviates too much from the normalized covariance measure of the variable estimator, otherwise the smoothing factor is slow, i.e.

$$\overline{\alpha}(m) = \begin{cases} \alpha_0, \ |\tilde{\rho}(m) - \overline{\rho}(m)| \leqq \epsilon \\ \tilde{\alpha}, \ |\tilde{\rho}(m) - \overline{\rho}(m)| > \epsilon \end{cases} \quad (18)$$

where $\alpha_0$ is a slow time constant smoothing factor, i.e. $\alpha_0<\overline{\alpha}$, and $\in$ is a constant. Note that the same smoothing factor $\overline{\alpha}(m)$ is used across frequency bands k.

Figure 15A:
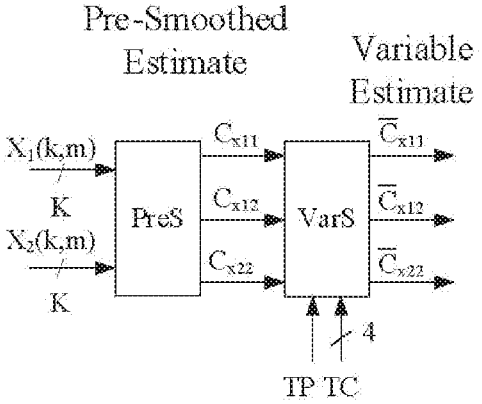
FIGS. 15A, 15B and 15C illustrate a general embodiment of a variable time constant covariance estimator according to the present disclosure, wherein FIG. 15A schematically shows a covariance smoothing unit according to the present disclosure comprising a pre-smoothing unit (PreS) and a variable smoothing unit (VarS).
Figure 15B:
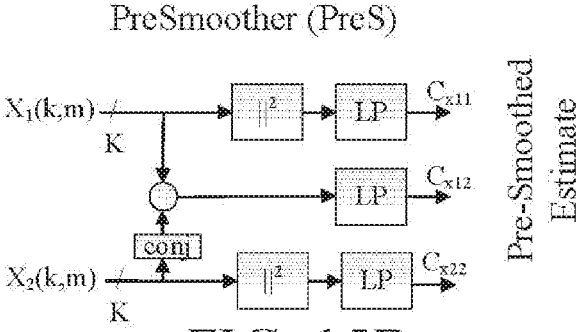
Figure 15C:
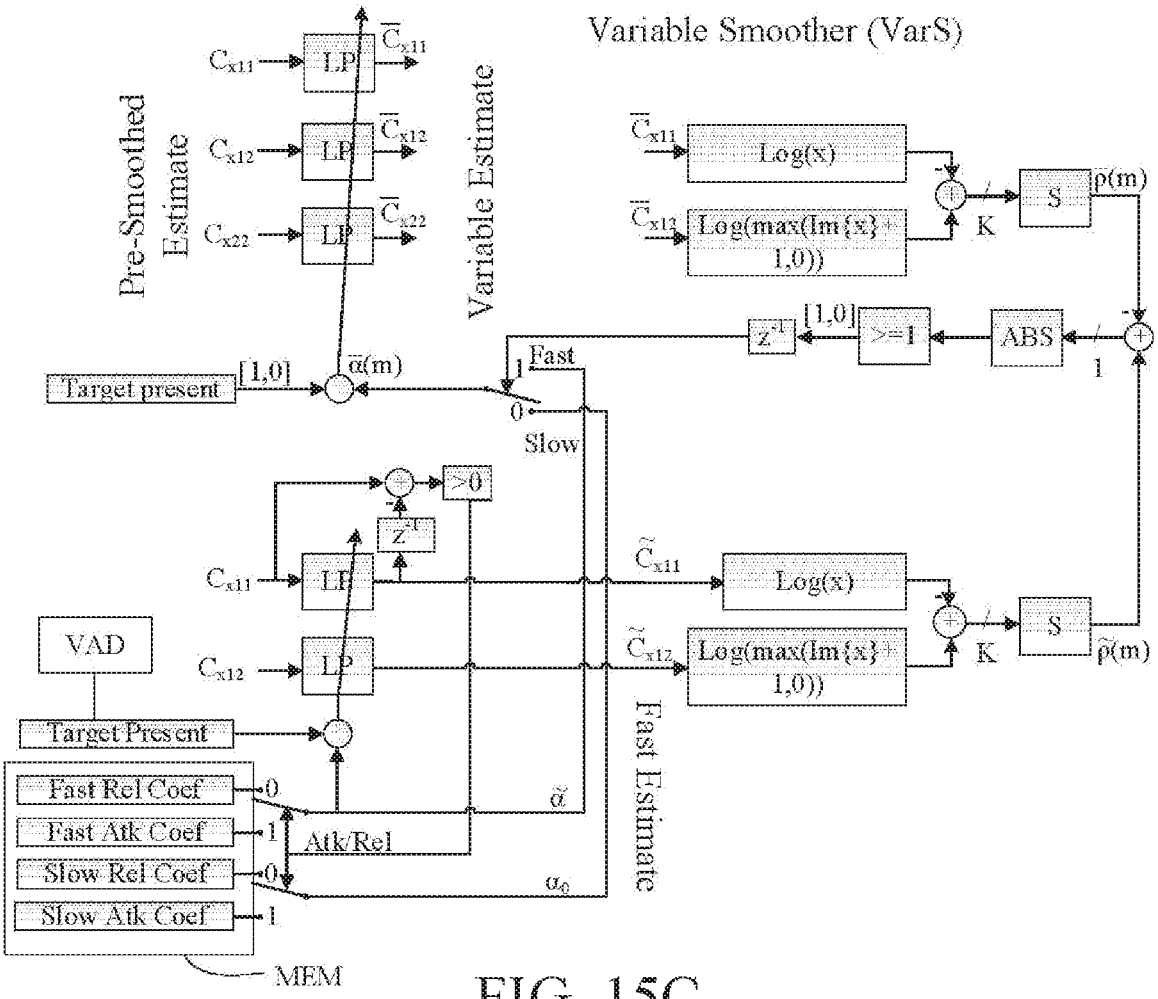

FIGS. 15A, 15B and 15C illustrate a general embodiment of the variable time constant covariance estimator as outlined above.

FIG. 15A schematically shows a covariance smoothing unit according to the present disclosure. The covariance unit comprises a pre-smoothing unit (PreS) and a variable smoothing unit (VarS). The pre-smoothing unit (PreS) makes an initial smoothing over time of instantaneous covariance matrices $C(m)=X(m)X(m)^H$ (e.g. representing the covariance/variance of noisy input signals X) in K frequency bands and provides pre-smoothed covariance matrix estimates $X_{11}$, $X_{12}$ and $X_{22}$ ($\langle C\rangle_{pre}=\langle X(M)X(M)^H\rangle$, where $\langle\cdot\rangle$ indicates LP-smoothing over time). The variable smoothing unit (VarS) makes a variable smoothing of the signals $X_{11}$, $X_{12}$ and $X_{22}$ based on adaptively determined attack and release times in dependence of changes in the acoustic environment as outlined above, and provides smoothed covariance estimators $\overline{C}_{x11}(m)$, $\overline{C}_{x12}(m)$, and $\overline{C}_{x22}(m)$.

The pre-smoothing unit (PreS) makes an initial smoothing over time (illustrated by ABS-squared units $|\cdot|^2$ for providing magnitude squared of the input signals $X_i(k,m)$ and subsequent low-pass filtering provided by low-pass filters LP) to provide pre-smoothed covariance estimates $C_{x11}$, $C_{x12}$ and $C_{x22}$, as illustrated in FIG. 15B. $X_1$ and $X_2$ may e.g. represent first (e.g. front) and second (e.g. rear) (typically noisy) microphone signals of a hearing aid. Elements $C_{x11}$, and $C_{x22}$, represent variances (e.g. variations in amplitude of the input signals), whereas element $C_{x12}$ represent co-variances (e.g. representative of changes in phase (and thus direction) (and amplitude)).

FIG. 15C shows an embodiment of the variable smoothing unit (VarS) providing adaptively smoothed of covariance estimators $\overline{C}_{x11}(m)$, $\overline{C}_{x12}(m)$, and $\overline{C}_{x22}(m)$, as discussed above.

The Target Present input is e.g. a control input from a voice activity detector. In an embodiment, the Target Present input (cf. signal TP in FIG. 15A) is a binary estimate (e.g. 1 or 0) of the presence of speech in a given time frame or time segment. In an embodiment, the Target Present input represents a probability of the presence (or absence) of speech in a current input signal (e.g. one of the microphone signals, e.g. $X_1(k,m)$). In the latter case, the Target Present input may take on values in the interval between 0 and 1. The Target Present input may e.g. be an output from a voice activity detector (cf. VAD in FIG. 15C), e.g. as known in the art.

The Fast Rel Coef, the Fast Atk Coref, the Slow Rel Coef, and the Slow Atk Coef are fixed (e.g. determined in advance of the use of the procedure) fast and slow attack and release times, respectively. Generally, fast attack and release times are shorter than slow attack and release times. In an embodiment, the time constants (cf. signals TC in FIG. 15A) are stored in a memory of the hearing aid (cf. e.g. MEM in FIG. 15A). In an embodiment the time constants may be updated during use of the hearing aid.

It should be noted that the goal of the computation of $y=\log(\max(\mathrm{Im}\{x12\}+1,0))-\log(x11)$ (cf. two instances in the right part of FIG. 15C forming part of the determination of the smoothing factor $\overline{\alpha}(m)$) is to detect changes in the acoustical sound scene, e.g. sudden changes in target direction (e.g. due to a switch of current talker in discussion/convesation). The exemplary implementation in FIG. 15C is chosen for its computational simplicity (which is of importance in a hearing device having a limited power budget), as provided by the conversion to a logarithmic domain. A mathematically more corect (but computationally more complex) implementation would be to compute $y=x12/x11$ (as exemplified in the determination of β illustrated in FIG. 3 and FIG. 7 (and FIG. FIG. 17A, 17B).

The adaptive low-pass filters used in FIG. 15C can e.g. be implemented as shown in FIG. 4, where coef is the smoothing factor $\overline{\alpha}(m)$ (or $\tilde{\alpha}(m)$).

FIGS. 16A, 16B and 16C illustrate a particular embodiment of the variable time constant covariance estimator as outlined above. The difference of the embodiment of FIGS. 16A, 16B and 16C to the general embodiment of FIG. 15A, 15B, 15C is that the inputs are beamformed signals formed by beam patterns C1 and C2 (instead of microphone signals x directly). FIG. 16D schematically illustrates the determination of β based on smoothed covariance matrices ($<|C2|^2>$, $<C1C2^*>$) according to the present disclosure (as exemplified in FIG. 17A, 17B).

The above scheme may e.g. be relevant for adaptively estimating a direction of arrival of alternatingly active sound sources at different locations (e.g. at different angles in a horizontal plane relative to a user wearing one or more hearing aids according to the present disclosure).

Figure 17A:
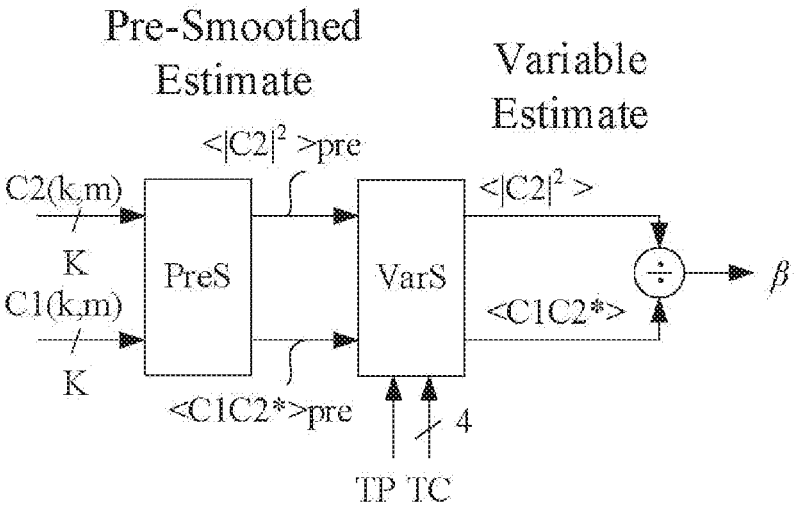
FIG. 17A schematically illustrates a first embodiment of the determination of β based on smoothed covariance matrices according to the present disclosure (compare FIG. 3), and FIG. 17B schematically illustrates a second embodiment of the determination of β based on smoothed covariance matrices and further smoothing according to the present disclosure (compare FIG. 7), and FIG. 18 schematically illustrates a third embodiment of the determination of β according to the present disclosure.
Figure 17B:
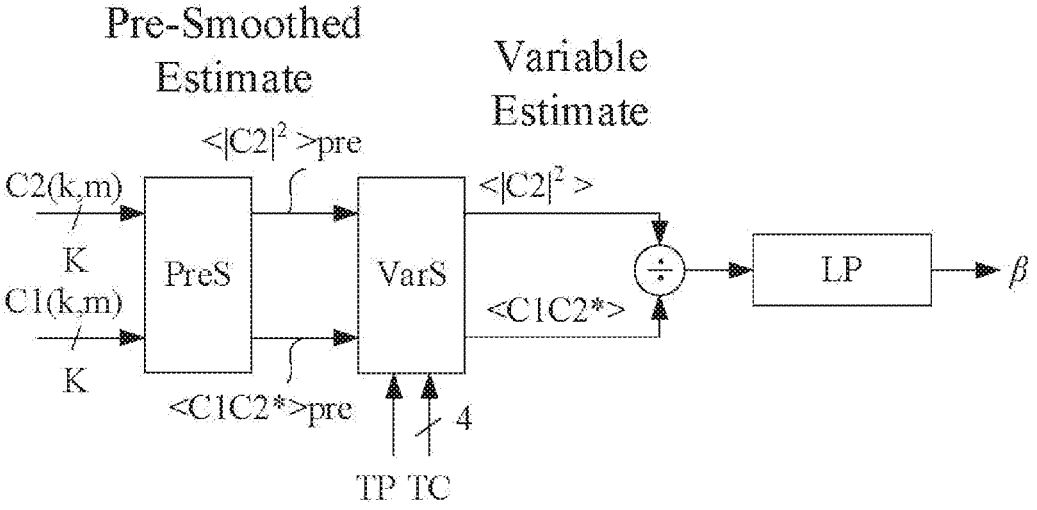

FIG. 17A corresponds to FIG. 3 and FIG. 17B corresponds to FIG. 7, but in FIGS. 17A and 17B, the variable time constant covariance estimator according to the present disclosure (and as depicted in FIG. 16A-16C) is used for adaptively smoothing β.

Figure 18:
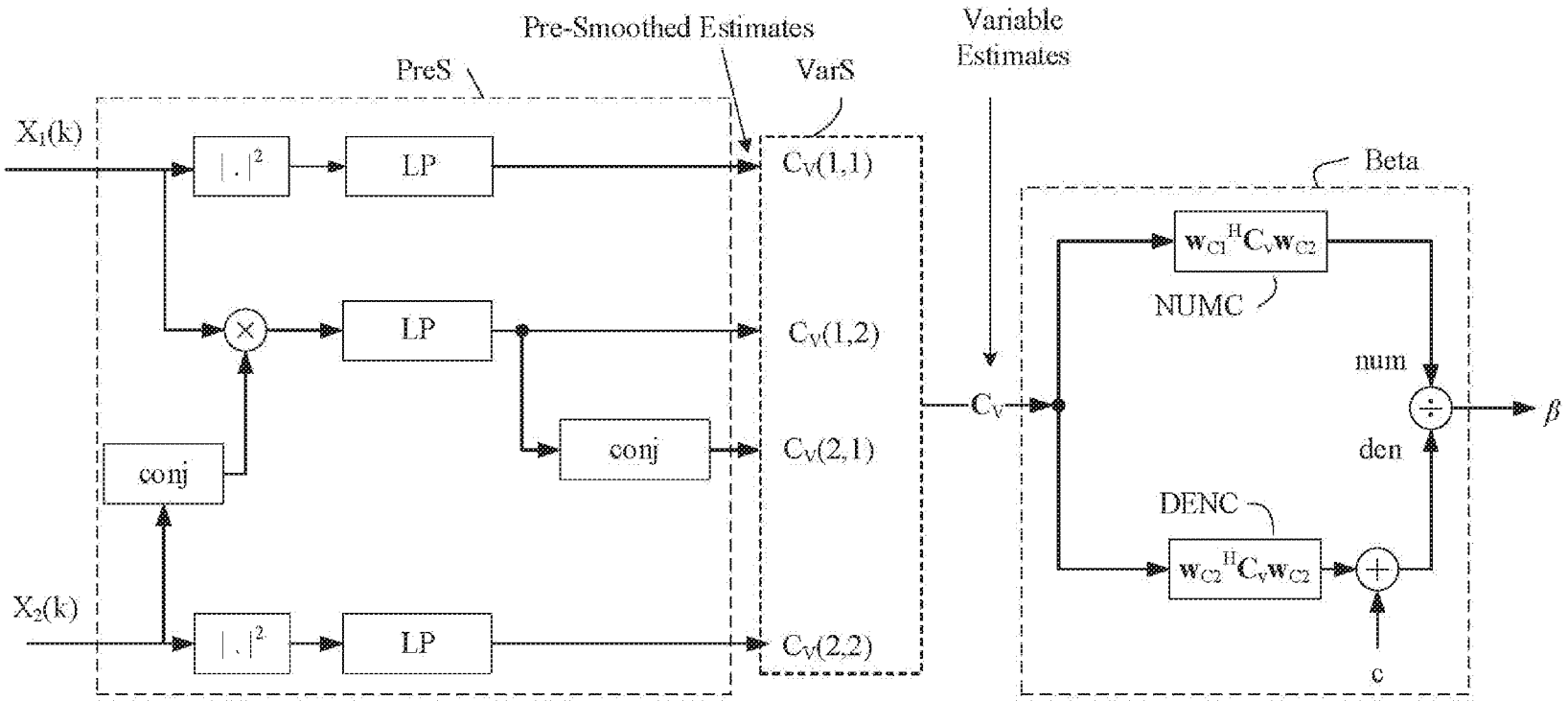

FIG. 18 comprises a pre-smoothing unit (PreS), a variable smoothing unit (VarS) and a β calculation unit (beta) as also illustrated in FIGS. 17A and 17B, but in an alternative embodiment.

FIG. 18 illustrates how β can be determined from the (e.g. smoothed) noise covariance matrix $<C_v>$(during speech pauses 'VAD=0') according to the present disclosure, contrary to calculating the beamformers. The LP blocks may be time varying (e.g. adaptive) as e.g. shown in connection with FIG. 15C and FIG. 16C. Instead of showing all the multiplications, two matrix multiplication blocks (NUMC, and DENC, respectively), for determining the numerator (num) and denominator (den) of the calculation of β are indicated in FIG. 18. An advantage of this implementation is that the beamformer coefficients may be modified without affecting the smoothing. This comes at the cost that this implementation requires more multiplications and an additional LP filter.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A method of operating a hearing device, the method comprising providing first and second electric input signals, adaptively providing a beamformed signal, based on said first and second electric input signals utilizing adaptive smoothing of a covariance matrix for said electric input signals, said adaptive smoothing comprising adaptively changing time constants for said smoothing in dependence of changes over time in covariance of said first and second electric input signals.

2. A method according to claim 1 wherein said time constants have first values for changes in covariance below a first threshold value and second values for changes in covariance above a second threshold value, wherein the first values are larger than corresponding second values of said time constants, while said first threshold value is smaller than or equal to said second threshold value.

3. A method according to claim 1 wherein the first and second electric input signals are provided in a time frequency representation $X_1(k,m)$ and $X_2(k,m)$, respectively, where k is a frequency index, k=1, . . . , K and m is time frame index.

4. A method according to claim 1 wherein said changes over time in covariance of said first and second electric input signals are related to changes over one or more, overlapping or non-overlapping, time frames.

5. A method according to claim 1 wherein said time constants represent attack and release time constants, respectively, for said smoothing.

6. A method according to claim 1 comprising adaptively estimating a direction of arrival of sound from a target sound source to a person.

7. A non-transitory computer-readable medium having stored there on program code which causes a processor to perform the method of claim 1.

8. The method of claim 1, wherein the hearing device is constituted by or comprises a hearing aid.

9. A hearing device, comprising first and second microphones for converting an input sound to first and second electric input signals, respectively, an adaptive beam former filtering unit configured to adaptively provide a resulting beamformed signal, based on said first and second electric input signals, and covariance matrix for said first and second electric input signals; the beamformer filtering unit comprising a smoothing unit configured to adaptively smooth elements of said covariance matrix with adaptively changing time constants for said smoothing in dependence of changes over time in covariance of said first and second electric input signals to provide an adaptively smoothed covariance matrix, and wherein the adaptive beamformer filtering unit is configured to utilize said adaptively smoothed covariance matrix to determine said beamformed signal.

10. A hearing device according to claim 9 wherein said time constants have first values for changes in covariance below a first threshold value and second values for changes in covariance above a second threshold value, wherein the first values are larger than corresponding second values of said time constants, while said first threshold value is smaller than or equal to said second threshold value.

11. A hearing device according to claim 9 comprising respective time to time-frequency conversion units for providing the first $X_1$ and second $X_2$ electric input signals in a time frequency representation $X_1(k,m)$ and second $X_2(k,m)$, where k is a frequency index, k=1, . . . , K and m is time frame index.

12. A hearing device according to claim 9 wherein said changes over time in covariance of said first and second electric input signals are related to changes over one or more, overlapping or non-overlapping, time frames.

13. A hearing device according to claim 9 wherein said time constants represent attack and release time constants, respectively.

14. A hearing device according to claim 9 wherein the smoothing unit comprises a low pass filter implemented as an IIR filter with a fixed time constant, and an IIR filter with a configurable time constant.

15. A hearing device according to claim 14 wherein the smoothing unit is configured to provide that the smoothing time constants take values between 0 and 1, and wherein a coefficient close to 0 applies averaging with a first time constant, while a coefficient close to 1 applies a second time constant, where the first time constant is larger than the second time constant.

16. A hearing device according to claim 14 wherein the smoothing unit comprises a multitude of $1^{st}$ order IIR filters.

17. A hearing device according to claim 14 wherein said IIR filter is a $1^{st}$ order IIR filter.

18. A hearing device according to claim 9 wherein said beamformer filtering unit is configured to estimate a look vector based on estimates of an adaptively smoothed noisy input covariance matrix and an adaptively smoothed noise only covariance matrix.

19. A hearing device according to claim 9 configured to adaptively estimating a direction of arrival of sound from a target sound source to a person wearing the hearing device.

20. A hearing device according to claim 9 wherein the smoothing unit comprises a pre-smoothing unit to provide pre-smoothed covariance estimates and a variable smoothing unit providing adaptively smoothed covariance estimators.

21. The hearing device of claim 9, wherein the hearing device is constituted by or comprises a hearing aid.

* * * * *